US008955424B2

(12) United States Patent
Ishibashi et al.

(10) Patent No.: US 8,955,424 B2
(45) Date of Patent: Feb. 17, 2015

(54) LINEAR ACTUATOR

(75) Inventors: Koichiro Ishibashi, Tsukubamirai (JP); Seiji Takanashi, Noda (JP); Motohiro Sato, Toride (JP); Jiro Mandokoro, Moriya (JP); Koji Hara, Tsukubamirai (JP); Toshio Sato, Tsukuba (JP)

(73) Assignee: SMC Kabushiki Kaisha, Tokyo (JP)

( * ) Notice: Subject to any disclaimer, the term of this patent is extended or adjusted under 35 U.S.C. 154(b) by 958 days.

(21) Appl. No.: 12/981,214

(22) Filed: Dec. 29, 2010

(65) Prior Publication Data

US 2011/0162520 A1 Jul. 7, 2011

Related U.S. Application Data

(63) Continuation-in-part of application No. 12/813,946, filed on Jun. 11, 2010, now abandoned.

(30) Foreign Application Priority Data

Jan. 5, 2010 (JP) ..... 2010-000566
Oct. 6, 2010 (JP) ..... 2010-226848

(51) Int. Cl.
*F01B 29/00* (2006.01)
*F15B 15/14* (2006.01)
*F15B 15/24* (2006.01)

(52) U.S. Cl.
CPC ..... *F15B 15/1404* (2013.01); *F15B 15/1471* (2013.01); *F15B 15/24* (2013.01)
USPC ..... 92/88; 92/23; 92/146

(58) Field of Classification Search
CPC ..... F15B 15/226; F15B 15/1471; F15B 15/1404; F15B 15/24; F15B 15/1438
USPC ..... 92/88, 23, 146
See application file for complete search history.

(56) References Cited

U.S. PATENT DOCUMENTS 3,859,147 A 1/1975 Philip
3,994,539 A * 11/1976 Gottlieb ..... 384/49
(Continued)

FOREIGN PATENT DOCUMENTS

CN 1690450 A 11/2005
CN 1815046 A 8/2006
(Continued)

OTHER PUBLICATIONS

U.S. Appl. No. 12/813,879, filed Jun. 11, 2010, Ishibashi, et al.
(Continued)

*Primary Examiner* — Edward Look
*Assistant Examiner* — Michael Quandt
(74) *Attorney, Agent, or Firm* — Oblon, Spivak, McClelland, Maier & Neustadt, L.L.P.

(57) ABSTRACT

A linear actuator includes a cylinder main body. With respect to the cylinder main body, a slide table is disposed for reciprocal displacement through a guide mechanism, which is disposed on the cylinder main body. A stopper mechanism having a stopper bolt is disposed on one end of the slide table centrally in a widthwise direction perpendicular to the longitudinal direction of the slide table. In addition, when the slide table is displaced along the cylinder main body, an end of the stopper bolt comes into abutment with an end of a cover of the guide mechanism, whereupon the slide table becomes engaged therewith and movement of the slide table is stopped.

14 Claims, 21 Drawing Sheets

(56) References Cited

U.S. PATENT DOCUMENTS

| | | | | |
|---|---|---|---|---|
| 4,748,866 | A | 6/1988 | Weyer | |
| 5,097,716 | A * | 3/1992 | Barbat et al. | 74/89.32 |
| 5,363,741 | A * | 11/1994 | Takada et al. | 92/13.5 |
| 5,511,461 | A * | 4/1996 | Miyachi et al. | 92/13.5 |
| 5,884,549 | A * | 3/1999 | Hosono et al. | 92/5 R |
| 6,014,924 | A * | 1/2000 | Stoll et al. | 92/13.5 |
| 6,336,390 | B1 | 1/2002 | Sato et al. | |
| 6,561,056 | B2 * | 5/2003 | Maffeis | 74/490.01 |
| 6,832,541 | B2 | 12/2004 | Satou et al. | |
| 7,090,400 | B2 | 8/2006 | Kato et al. | |
| 7,191,695 | B2 | 3/2007 | Sato et al. | |
| 7,290,479 | B2 | 11/2007 | Williams et al. | |
| 7,806,041 | B2 * | 10/2010 | Someya et al. | 92/146 |
| 2006/0056748 | A1 | 3/2006 | Maffeis | |

FOREIGN PATENT DOCUMENTS

| | | | |
|---|---|---|---|
| CN | 2837045 | Y | 11/2006 |
| CN | 101191508 | A | 6/2008 |
| JP | 59-58215 | | 4/1984 |
| JP | 2-109001 | U | 8/1990 |
| JP | 9-141533 | A | 6/1997 |
| JP | 10-61611 | A | 3/1998 |
| JP | 2586276 | | 9/1998 |
| JP | 11-125208 | A | 5/1999 |
| JP | 2001-263349 | A | 9/2001 |
| JP | 3795968 | | 4/2006 |
| JP | 2007-218296 | | 8/2007 |
| JP | 2008-057679 | | 3/2008 |
| JP | 2009-150455 | | 7/2009 |
| KR | 1998-024027 | | 7/1998 |
| KR | 10-2008-0049675 | | 6/2008 |
| TW | 460661 | | 10/2001 |
| TW | M310272 | | 4/2007 |
| TW | 200823373 | A | 6/2008 |
| TW | 200934963 | A | 8/2009 |

OTHER PUBLICATIONS

U.S. Appl. No. 13/042,629, filed Mar. 8, 2011, Ishibashi, et al.

Combined Office Action and Search Report issued Jan. 14, 2013 in Taiwanese Patent Application No. 099119239 with English language translation.

Notice of Allowance issued Apr. 3, 2012 in Korean Patent Application No. 2010-61823 (with English translation).

Office Action mailed Apr. 26, 2013, in co-pending U.S. Appl. No. 12/813,879.

Japanese Office Action issued Oct. 29, 2013 in Patent Application No. 2010-088546 with Partial English Translation.

Japanese Office Action issued Oct. 29, 2013 in Patent Application No. 2010-000564 with Partial English Translation.

Office Action issued on Jul. 1, 2014 in the corresponding Japanese Patent Application No. 2010-226848 (with English Translation).

Combined Chinese Office Action and Search Report issued Mar. 21, 2014 in Patent Application No. 201110009957.9 (with English language translation).

Office Action mailed Feb. 6, 2014, in co-pending U.S. Appl. No. 13/042,629.

Carpenter, Technical Data Sheet: "Carpenter Stainless Type 440 A", Edition: Apr. 1, 1987, Pertinent Paragraph: Type Analysis, [http://cartech.ides.com/datasheet.aspx?i=101&e=74], 4 pages.

* cited by examiner

LINEAR ACTUATOR

CROSS-REFERENCE TO RELATED APPLICATION

This application is based upon and is a Continuation-In-Part application of U.S. patent application Ser. No. 12/813,946, filed on Jun. 11, 2010, and claims the benefit of priority from Japanese Patent Applications No. 2010-000566 filed on Jan. 5, 2010 and No. 2010-226848 filed on Oct. 6, 2010, of which the contents are incorporated herein by reference.

BACKGROUND OF THE INVENTION

1. Field of the Invention

The present invention relates to a linear actuator in which, by introduction of a pressure fluid from fluid inlet/outlet ports, a slide table is made to move reciprocally along an axial direction of a cylinder main body.

2. Description of the Related Art

Heretofore, a linear actuator, for example made up of a fluid pressure cylinder or the like, has been used as a means for transporting workpieces. As disclosed in Japanese Utility Model No. 2586276, the present applicants have proposed a linear actuator, which is capable of transporting a workpiece that is loaded onto a slide table by causing the slide table to move reciprocally in a straight line along a cylinder main body.

Further, in Japanese Laid-Open Patent Publication No. 2008-057679, a linear actuator is disclosed equipped with a non-circulating guide mechanism, in which plural steel balls are disposed in a body between a guide rail and a slide table, such that the steel balls are displaced accompanying displacement of the slide table.

However, with the conventional technique according to the aforementioned Japanese Laid-Open Patent Publication No. 2008-057679, for example, in the event that the slide table is moved under a condition in which unbalanced loads are applied with respect to the slide table, shifting of the steel balls on left and right sides of the guide rails occurs, and along therewith, there is a concern that inclination (tilting) of the slide table may occur.

SUMMARY OF THE INVENTION

A general object of the present invention is to provide a linear actuator, which is capable of reliably and stably stopping motion of a slide table, and together therewith, of suppressing generation of moments at a time when the slide table is stopped, thereby suppressing inclination of the slide table, while also simplifying the design and enhancing ease of use of the linear actuator.

The present invention is a linear actuator in which, by introduction of a pressure fluid from fluid inlet/outlet ports, a slide table is made to move reciprocally along an axial direction of a cylinder main body, comprising:

the cylinder main body, which communicates with the fluid inlet/outlet ports and having a pair of cylinder chambers into which the pressure fluid is introduced;

the slide table, which moves reciprocally along the axial direction of the cylinder main body;

a cylinder mechanism having a pair of pistons which are slidable along the cylinder chambers, wherein the slide table is made to move reciprocally under a displacement action of the pistons;

a guide mechanism for guiding the slide table along the axial direction of the cylinder main body, the guide mechanism being attached to the cylinder main body and having a flat guide block with circulation passages formed therein through which a plurality of rolling bodies roll and circulate; and a stopper mechanism disposed on one end of the slide table centrally in a widthwise direction thereof perpendicular to an axial direction of the slide table for regulating reciprocal movement of the slide table, wherein the stopper mechanism is displaced together with the slide table and abuts against an end of the guide block.

According to the present invention, in such a linear actuator equipped with a pair of pistons in the cylinder main body, the stopper mechanism for regulating reciprocal movement of the slide table is disposed centrally in the widthwise direction on one end of the slide table, wherein the slide table moves reciprocally along the axial direction of the cylinder main body. Additionally, when the slide table is moved reciprocally by means of the cylinder mechanism including the pistons therein, the stopper mechanism, which is displaced together with the slide table, abuts against one end of the guide block of the guide mechanism, thereby stopping movement of the slide table.

Accordingly, because the stopper mechanism is disposed centrally in the widthwise direction on one end of the slide table, when the stopper mechanism abuts against one end of the guide block and engages therewith, generation of moments in the lateral direction as viewed from above the linear actuator are suppressed, and inclination of the slide table, which might otherwise occur when the slide table engages with the guide block, can be avoided. As a result, movement of the slide table can be stopped reliably and stably by the stopper mechanism.

The above and other objects features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
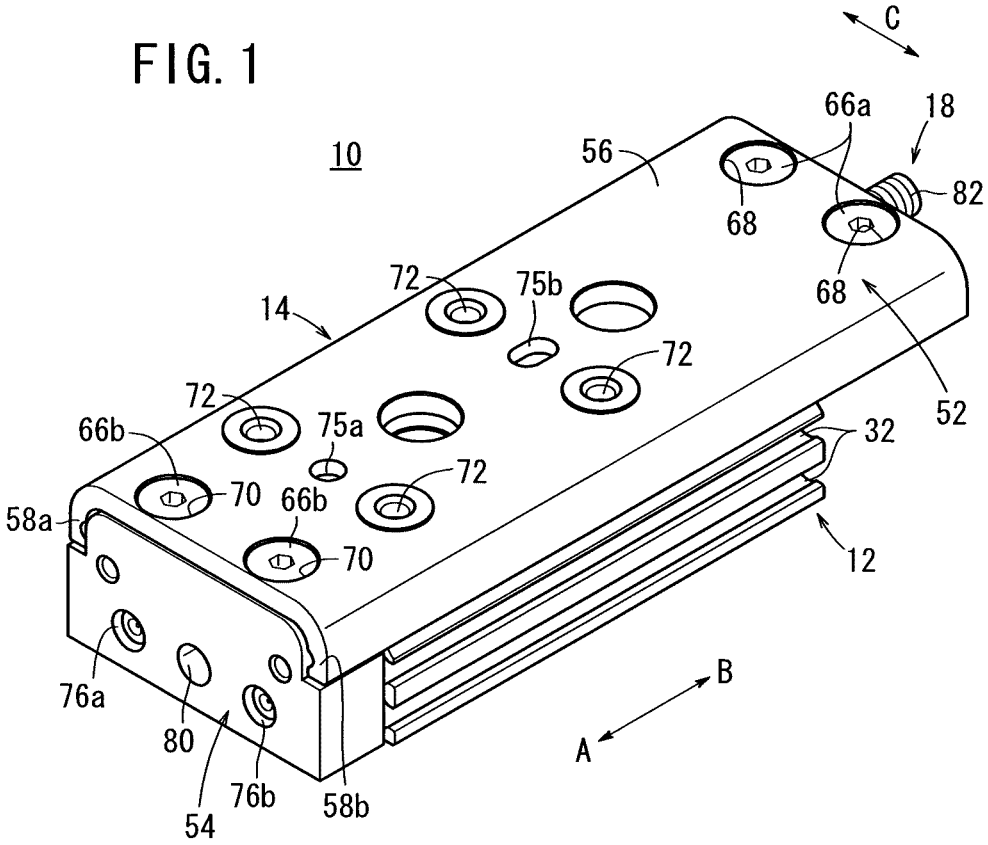
FIG. 1 is an exterior perspective view of a linear actuator according to a first embodiment of the present invention.
Figure 2:
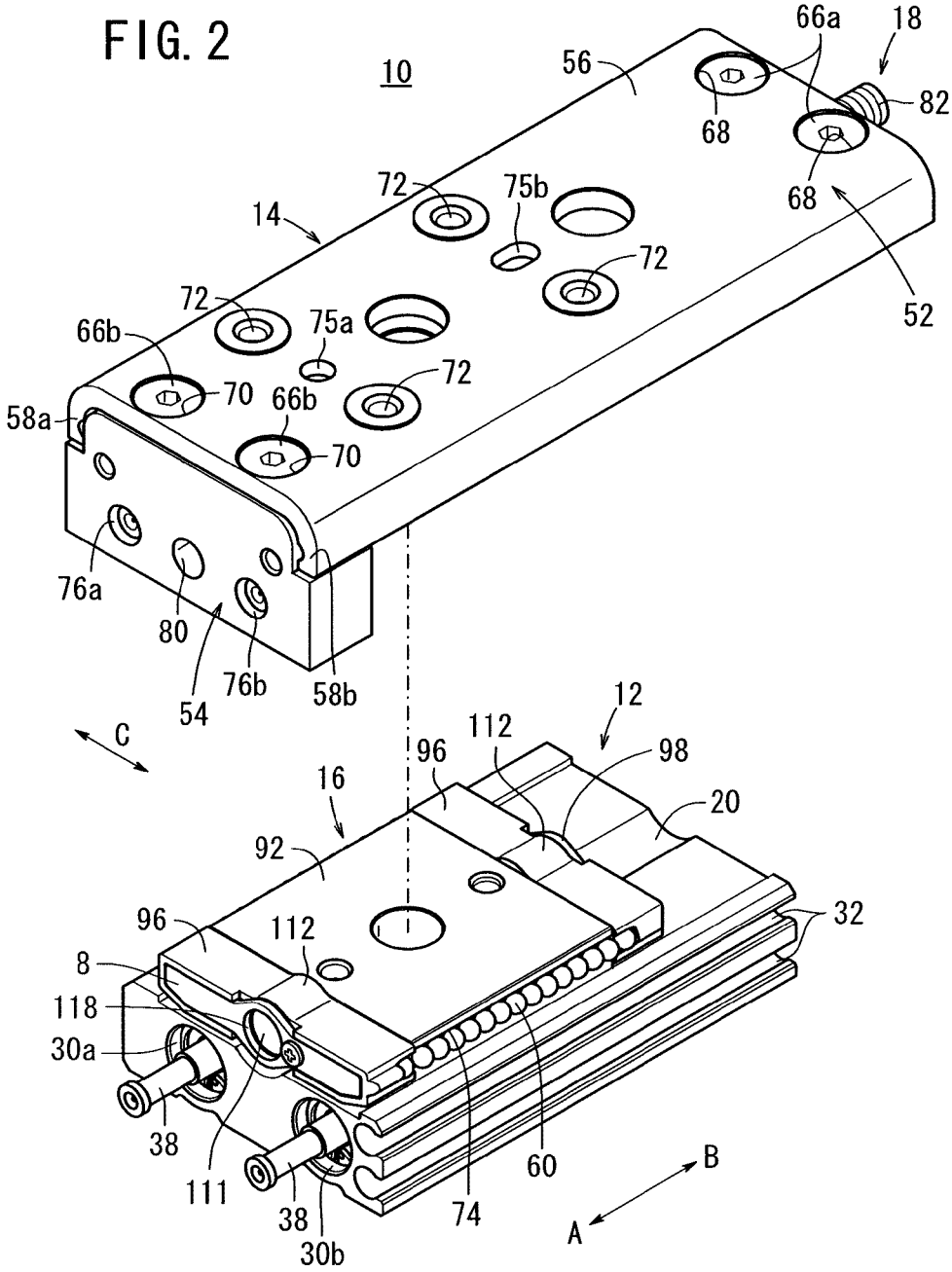
FIG. 2 is an exploded perspective view showing a condition in which a slide table is separated upwardly away from the linear actuator of FIG. 1.

In FIG. 1, reference numeral 10 indicates a linear actuator according to a first embodiment of the present invention.

As shown in FIGS. 1 through 10, the linear actuator 10 comprises a cylinder main body 12, a slide table 14 disposed on an upper portion of the cylinder main body 12 and which makes reciprocal motion in a straight line along a longitudinal direction (the direction of arrows A and B), a guide mechanism 16 disposed to intervene between the cylinder main body 12 and the slide table 14, for guiding the slide table 14 in the longitudinal direction (the direction of arrows A and B), and a stopper mechanism 18, which is capable of adjusting a displacement amount of the slide table 14.

The cylinder main body 12 has a rectangular cross section and has a predetermined length along the longitudinal direction (the direction of arrows A and B). A recess 20 having a sunken arcuate shape in cross section is formed roughly in the center on the upper surface of the cylinder main body 12, extending along the longitudinal direction (the direction of arrows A and B). In the recess 20, a pair of penetrating bolt holes 24*a*, 24*b* is provided, through which connecting bolts 22*a*, 22*b* are inserted for connecting the cylinder main body 12 with the guide mechanism 16.

Figure 5:
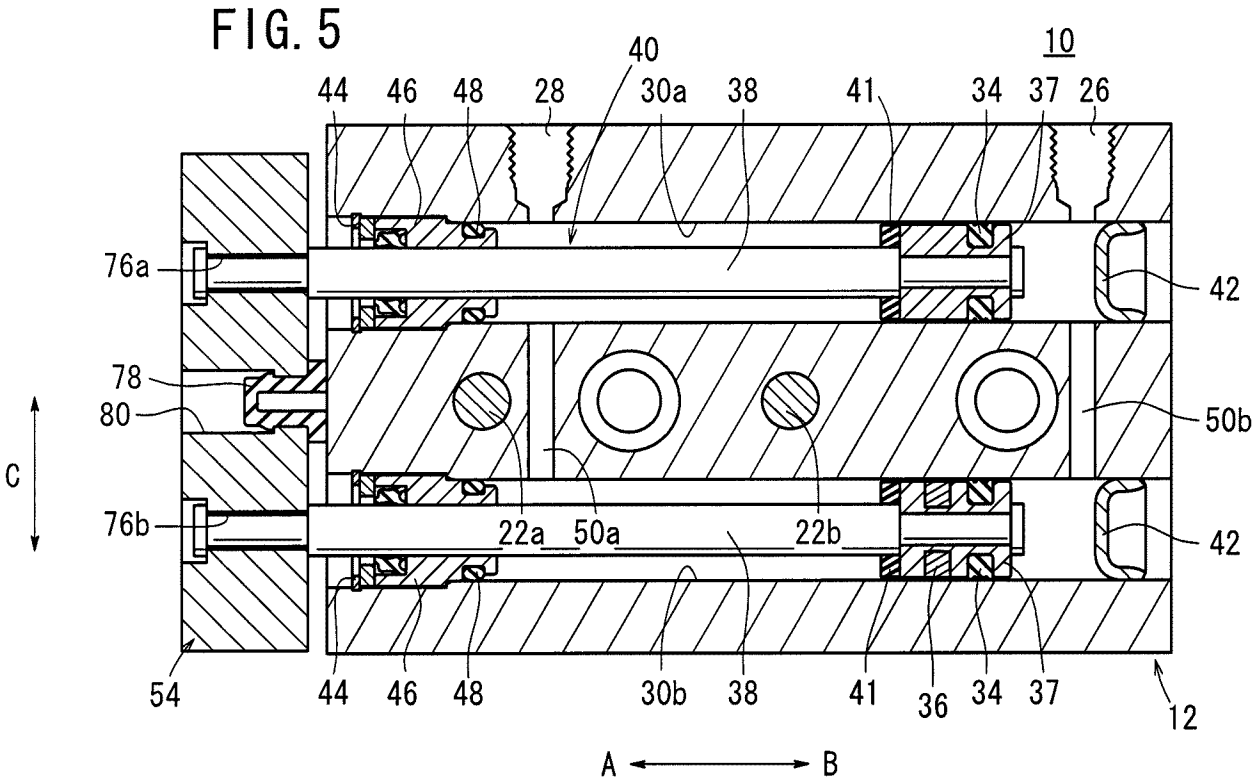
FIG. 5 is a cross sectional view taken along line V-V of FIG. 4.
Figure 6:
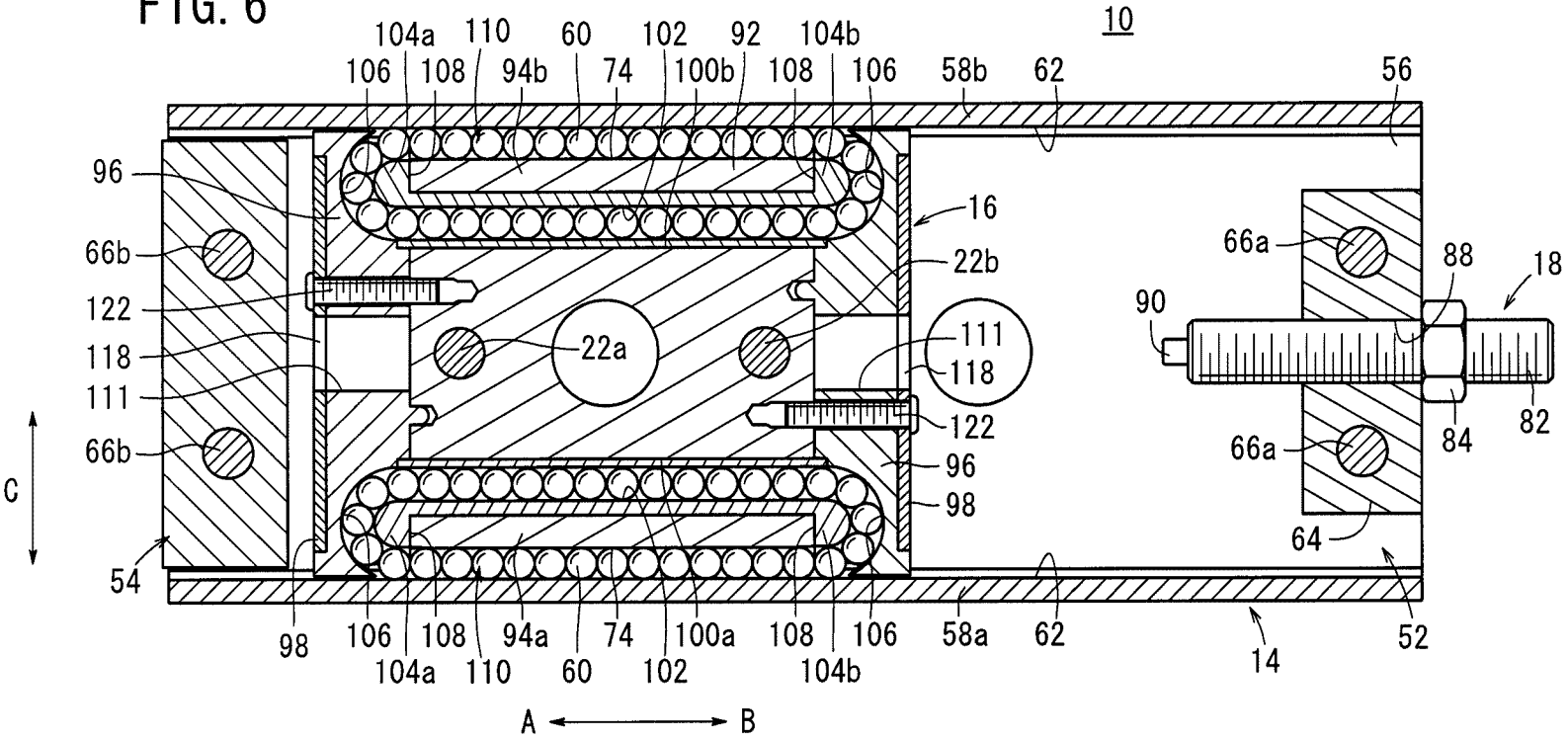
FIG. 6 is a cross sectional view taken along line VI-VI of FIG. 4.

Further, as shown in FIG. 5, on one side surface of the cylinder main body 12, first and second ports (fluid inlet/outlet ports) 26, 28 for supply and discharge of a pressure fluid are formed perpendicularly to the longitudinal direction of the cylinder main body 12, which communicate with a pair of penetrating holes (cylinder chambers) 30*a*, 30*b* to be described later. Furthermore, on the other side surface of the cylinder main body 12, two sensor attachment grooves 32 are formed respectively at positions along the longitudinal direction (the direction of arrows A and B), which have sensors (not shown) mounted therein.

Figure 3:
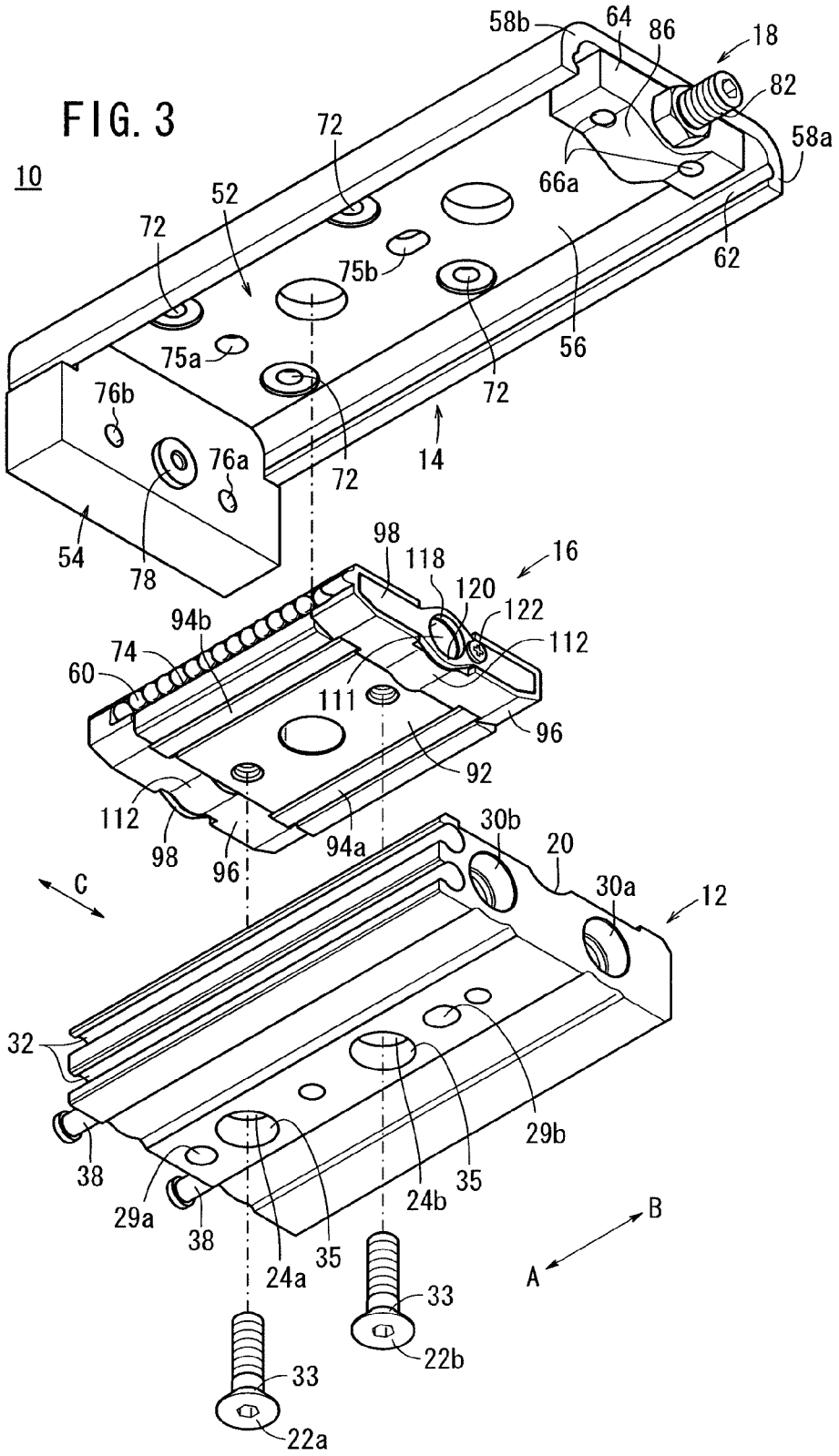
FIG. 3 is an exploded perspective view as seen from a lower side of the linear actuator of FIG. 1.
Figure 4:
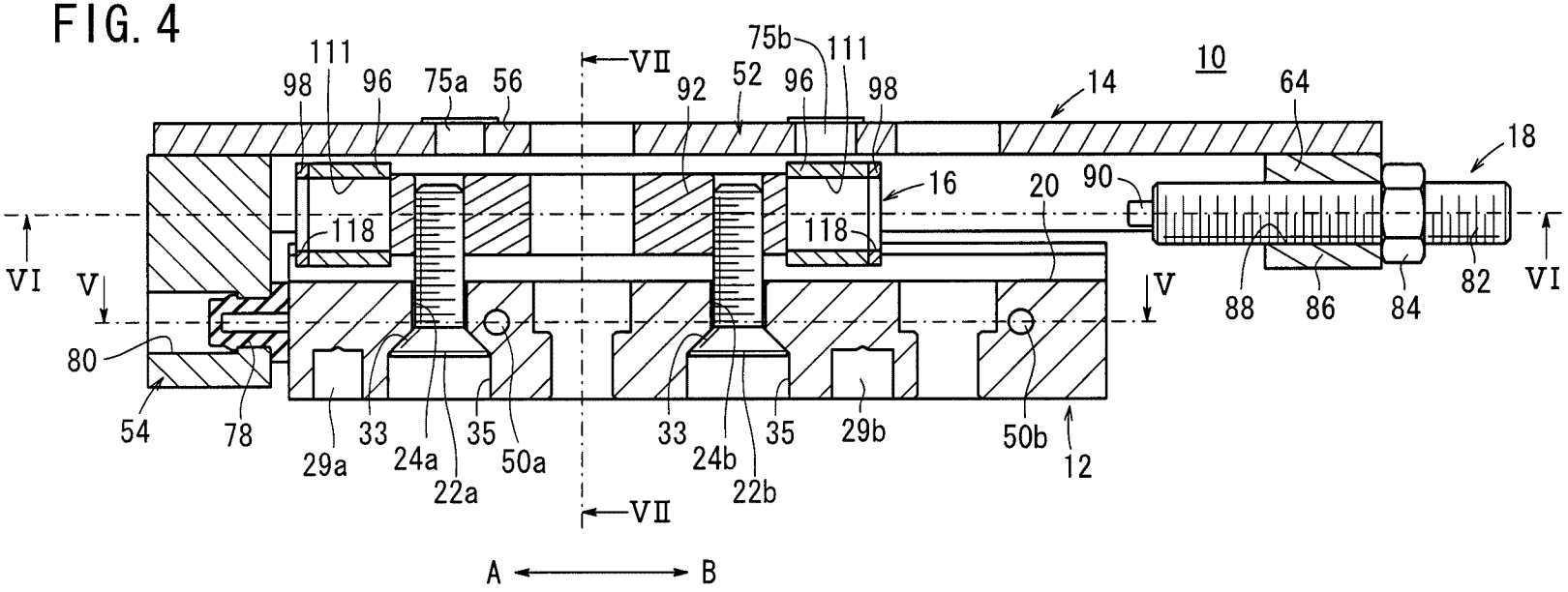
FIG. 4 is an overall vertical cross sectional view of the linear actuator of FIG. 1.

On the bottom surface of the cylinder main body 12, as shown in FIGS. 3 and 4, the pair of bolt holes 24*a*, 24*b* are formed centrally in the widthwise direction (the direction of arrow C) on the axial line. The connecting bolts 22*a*, 22*b* are inserted from below through the bolt holes 24*a*, 24*b*, which penetrate upwardly through the cylinder main body 12.

Heads 33 of the connecting bolts 22*a*, 22*b* are made up from flush bolts having tapered shapes that gradually expand in diameter in a direction separating away from the threaded portions (downwardly as shown in FIG. 4). Expanded diameter portions 35 of the bolt holes 24*a*, 24*b* as well are formed in tapered shapes that gradually expand in diameter toward the lower surface side of the cylinder main body 12, so as to come into abutment with the tapered heads 33.

In addition, the threaded portions of the connecting bolts 22*a*, 22*b* penetrate from the upper surface of the cylinder main body 12, and are connected mutually by threaded engagement in a guide block 92 of the guide mechanism 16. At this time, as shown in FIG. 4, because the heads 33 on the connecting bolts 22*a*, 22*b* and the expanded diameter portions 35 of the bolt holes 24*a*, 24*b* come into abutment through tapered surfaces, even in the case that loads are applied in a horizontal direction (the direction of arrows A and B) with respect to the guide block 92, due to engagement between the tapered surfaces, the connecting bolts 22*a*, 22*b* are not displaced in a direction perpendicular to the axial line (i.e., in the direction of arrows A and B).

Owing thereto, the guide block 92 is fixed strongly in a state of always being positioned properly with respect to the cylinder main body 12. Stated otherwise, because slippage (displacement) of the connecting bolts 22*a*, 22*b* in directions perpendicular to the axial line is regulated, the guide block 92 is retained in a condition of being positioned with high precision, and along therewith, the displacement amount of the slide table 14, which is stopped through the stopper mechanism 18, can be controlled highly accurately.

Further, on the lower surface of the cylinder main body 12, a pair of first positioning holes 29*a*, 29*b* is formed on the axial line centrally in the widthwise direction (the direction of arrow C), such that, for example, when the cylinder main body 12 of the linear actuator 10 is fixed to another apparatus or the like (not shown) by insertion of pins through the first positioning holes 29*a*, 29*b* and into the other apparatus, relative positioning thereof is accomplished.

As shown in FIGS. 3 and 4, the first positioning holes 29*a*, 29*b* are formed adjacent to the bolt holes 24*a*, 24*b*, such that one of the first positioning holes 29*a* is formed to penetrate in a circular shape on one end side (in the direction of arrow A) of the cylinder main body 12 from which later-described piston rods 38 project, and the other of the first positioning holes 29*b*, which is formed on the other end side (in the direction of arrow B) of the cylinder main body 12, is formed in an elliptical or oblong shape with the longitudinal dimension thereof extending along the axial direction (in the direction of arrows A and B).

In this manner, by providing the first positioning holes 29*a*, 29*b* on the axial line in the cylinder main body 12, operations can easily be performed when attachment and positioning of the linear actuator 10 including the cylinder main body 12 thereof onto another apparatus is carried out.

On the other hand, as shown in FIG. 5, inside the cylinder main body 12, two penetrating holes 30*a*, 30*b* are formed, which penetrate along the longitudinal direction (the direction of arrows A and B), the one penetrating hole 30*a* and the other penetrating hole 30*b* being disposed substantially in parallel to each other and separated by a predetermined distance. Inside the penetrating holes 30*a*, 30*b*, a cylinder mechanism 40 is provided, including respective pistons 37 each of which has a sealing ring 34 installed on an outer circumference thereof, and the piston rods 38 connected to the pistons 37.

The cylinder mechanism 40 is constituted by the pair of pistons 37 and piston rods 38, which are installed respectively in the pair of penetrating holes 30*a*, 30*b*. Further, on the outer circumferential surface of one of the pistons 37, a magnet 36 is installed alongside the sealing ring 34. The magnet 36 is provided only on one of the pistons 37 on the side of the sensor attachment groove 32 in the cylinder main body 12. By means of a detection sensor (not shown) installed in the sensor attachment groove 32, magnetism of the magnet 36 is detected, whereby the displacement position of the pistons 37 along the axial direction is detected.

Furthermore, ring-shaped piston dampers 41 are provided on ends of the pistons 37 on the side of rod holders 46, to be described later (in the direction of arrow A). For example, even without providing the stopper mechanism 18, in the case that the pistons 37 are displaced toward the side of the rod holders 46 (in the direction of arrow A), the pistons 37 are stopped by abutment against the rod holders 46 via the piston dampers 41, and shocks are suitably absorbed by the piston dampers 41.

The penetrating holes 30*a*, 30*b* are closed and sealed at one end thereof by caps 42, whereas other ends of the penetrating holes 30*a*, 30*b* are sealed hermetically by the rod holders 46, which are retained therein via locking rings 44. On the outer periphery of the rod holders 46, o-rings 48 are installed via annular grooves, for thereby preventing leakage of pressure fluid through gaps between the penetrating holes 30*a*, 30*b* and the rod holders 46.

Furthermore, one of the penetrating holes 30*a* communicates respectively with the first and second ports 26, 28, whereas the other penetrating hole 30*b* also communicates mutually with the one penetrating hole 30*a* via a pair of connecting passages 50 formed between the one penetrating hole 30*a* and the other penetrating hole 30*b*. More specifically, pressure fluid is supplied to the first and second ports 26, 28 and introduced into the one penetrating hole 30*a*. Thereafter, the pressure fluid also is introduced into the other penetrating hole 30*b* through the connecting passages 50. The connecting passages 50 are formed perpendicularly to the direction of extension (the direction of arrows A and B) of the penetrating holes 30*a*, 30*b*.

The slide table 14 comprises a table main body 52, the stopper mechanism 18 connected to one end of the table main body 52, and an end plate 54 connected to the other end of the table main body 52. The end plate 54 is connected perpendicularly with respect to the table main body 52.

The table main body 52 is made up from a base member 56 that extends along the longitudinal direction with a predetermined thickness, and a pair of guide walls (wall members) 58*a*, 58*b* that extend downward perpendicularly from both sides of the base member 56. On inner surfaces of the guide walls 58*a*, 58*b*, first ball guide grooves 62 for guiding balls (rolling bodies) 60 of the guide mechanism 16, to be described later, are formed. The first ball guide grooves 62 are recessed with substantially semicircular shapes in cross section. Further, the base member 56 and the guide walls 58*a*, 58*b* are formed with substantially the same thickness dimension (see FIG. 7).

Further, on one end of the table main body 52, a pair of first bolt holes 68 is formed, through which bolts (fastening members) 66*a* are inserted for fixing a later-described holder portion (retaining member) 64 of the stopper mechanism 18. On the other end of the table main body 52, a pair of second bolt holes 70 is formed, through which bolts 66*b* are inserted for fixing the end plate 54. The first and second bolt holes 68, 70 penetrate in a direction perpendicular to the direction of extension (the direction of arrows A and B) of the table main body 52.

Four workpiece retaining holes 72 are formed in the base member 56 between the one end and the other end thereof. The workpiece retaining holes 72 are separated mutually by predetermined distances, and are provided, for example, with the aim of fixing the workpiece in place when the workpiece (not shown) is mounted and transported on an upper portion of the slide table 14.

Figure 7:
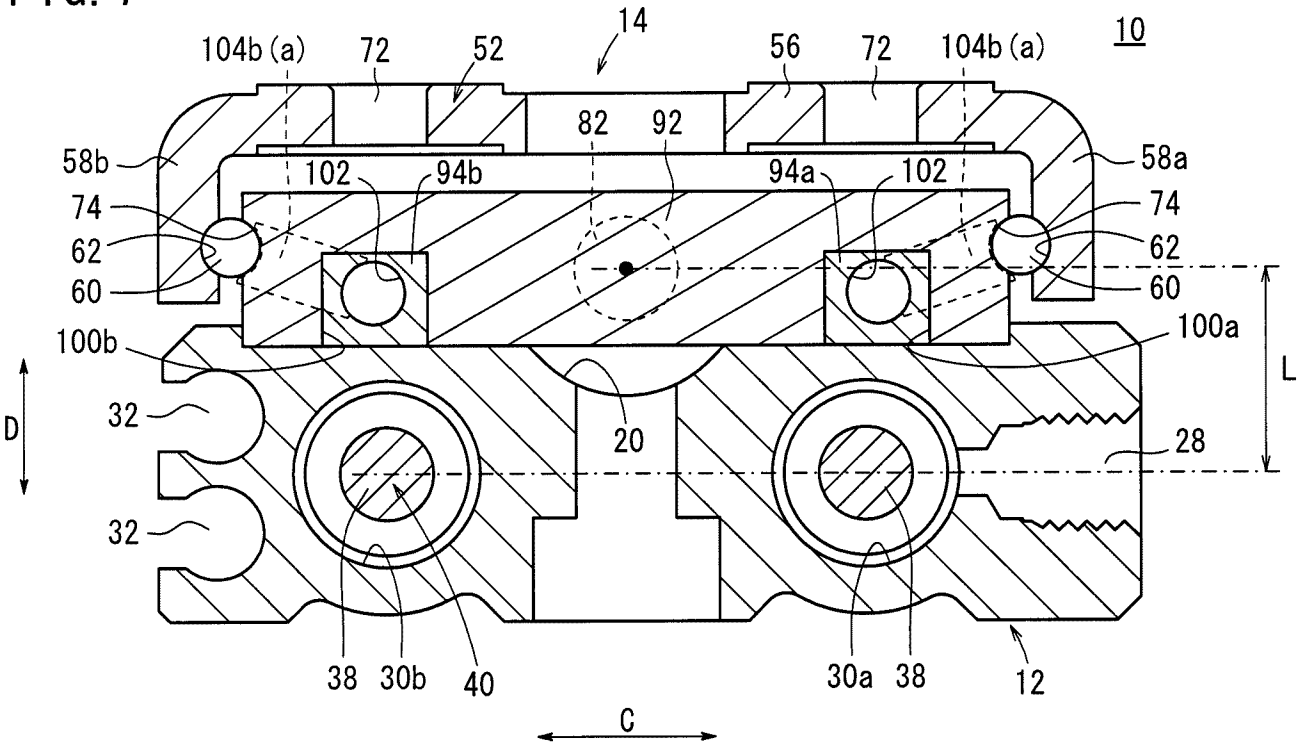
FIG. 7 is a cross sectional view taken along line VII-VII of FIG. 4.

In addition, when the slide table 14 is disposed on the upper portion of the cylinder main body 12, the workpiece retaining holes 72 are disposed toward the center side along the widthwise direction of the cylinder main body 12 and the guide block 92, with respect to second ball guide grooves 74, which are provided on opposite side surfaces of the guide block 92 (see FIG. 7). Stated otherwise, the workpiece retaining holes 72 are arranged in the slide table 14 at inner side positions from the second ball guide grooves 74 of the guide block 92.

Further, as shown in FIGS. 1 through 4, a pair of second positioning holes 75*a*, 75*b* are formed in the base member 56, into which non-illustrated pins are inserted for positioning a workpiece (not shown) on the axial line centrally in the widthwise dimension of the base member 56. The second positioning holes 75*a*, 75*b* are separated from each other mutually a predetermined distance along the longitudinal direction (the direction of arrows A and B) of the base member 56. One of the second positioning holes 75*a*, which is disposed on the side of the end plate 54 (in the direction of arrow A), is formed to penetrate therethrough with a circular shape, whereas the other of the second positioning holes 75*b*, which is disposed on the side of the stopper mechanism 18 (in the direction of arrow B), is formed in an elliptical or oblong shape with the longitudinal dimension thereof extending along the axial direction.

In this manner, by providing the second positioning holes 75*a*, 75*b* on the axial line of the base member 56 in the slide table 14, operations can easily be performed when mounting and positioning of a workpiece on the slide table 14 are carried out.

The end plate 54 is fixed by the two bolts 66*b*, which are inserted through the second bolt holes 70 formed on the other end of the table main body 52, and is disposed so as to face toward an end surface of the cylinder main body 12. The end plate 54 also is fixed to ends of the piston rods 38, which are inserted through a pair of rod holes 76*a*, 76*b* formed in the end plate 54. Owing thereto, the slide table 14 including the end plate 54 is displaceable together with the piston rods 38 along the longitudinal direction (the direction of arrows A and B) of the cylinder main body 12.

Further, on the end plate 54, a damper installation hole 80, into which a damper 78 is mounted, is formed at a position between the one rod hole 76*a* and the other rod hole 76*b*. When the damper 78, which is made from an elastic material such as rubber or the like, is mounted (inserted) in the damper installation hole 80 from the other side surface of the end plate 54 on the side of the cylinder main body 12, the end portion thereof is expanded in diameter and projects outwardly from the other side surface.

Due to the fact that the damper installation hole 80 is formed centrally in the widthwise direction (the direction of arrow C) of the end plate 54, the damper 78 likewise is installed centrally in the widthwise direction of the end plate 54.

More specifically, when the end plate 54 is displaced in unison with the slide table 14, by abutment of the damper 78 that projects from the other side surface of the end plate 54 against the end surface of the cylinder main body 12, generation of shocks and noises, which would be of concern if the end plate 54 were to abut directly against the cylinder main body 12, are avoided.

Furthermore, because the damper 78 is disposed roughly in a central portion in the widthwise direction (the direction of arrow C) of the end plate 54, when the slide table 14 is displaced, and the end plate 54 is stopped in abutment against the end surface of the cylinder main body 12 through the damper 78, generation of moments in a lateral (left-right) direction as viewed from above the linear actuator 10 is suppressed.

The stopper mechanism 18 includes the holder portion 64 disposed on a lower surface of one end of the table main body 52, a stopper bolt 82 screw-engaged with respect to the holder portion 64, and a lock nut 84 for regulating advancing and retracting movements of the stopper bolt 82. The stopper mechanism 18 is disposed so as to face toward an end surface of the guide mechanism 16, which is disposed on the cylinder main body 12.

The holder portion 64 is formed in a block-like shape and is fixed from above with respect to the base member 56 of the table main body 52 of the slide table 14 by the two bolts 66*a*, which are inserted from above via the first bolt holes 68. The holder portion 64 includes a first bulging portion (bulging portion) 86 that bulges downwardly with an arcuate shape in cross section roughly in the center of the holder portion 64. In the center of the holder portion 64 that includes the first bulging portion 86, a screw hole 88 is formed in which the stopper bolt 82 is screw-engaged. The screw hole 88 extends through the holder portion 64 substantially parallel to the direction of extension of the table main body 52.

More specifically, since the screw hole 88 is disposed in the center of the holder portion 64 having the first bulging portion 86, compared to a case in which such a first bulging portion 86 is not provided, the screw hole 88 can be formed at a slightly lower location.

Further, in the holder portion 64, the first bulging portion 86 extends in the axial direction, such that when the slide table 14 is displaced along the longitudinal direction, the first bulging portion 86 is inserted through the recess 20 of the cylinder main body 12.

The stopper bolt 82, for example, is made from a shank-shaped stud bolt engraved with threads on the outer peripheral surface thereof. The stopper bolt 82 has a length such that under a condition of screw-engagement in the screw hole 88 of the holder portion 64, the stopper bolt 82 projects from the screw hole 88. In addition, the lock nut 84 is screw-engaged with the stopper bolt 82 at a region projecting from an end surface of the holder portion 64.

Additionally, by threaded rotation of the stopper bolt 82 with respect to the holder portion 64, the stopper bolt 82 is displaced along the axial direction (the direction of arrows A and B), so as to approach and separate away from the guide mechanism 16. For example, after the stopper bolt 82 has been rotated so as to project a predetermined length toward the side of the guide mechanism 16 (in the direction of arrow A), the lock nut 84 is threadedly rotated to move and abut against the side surface of the holder portion 64, thereby regulating advancing and retracting movements of the stopper bolt 82.

Further, a shock-absorbing member 90 made from an elastic material projects a given length on the end of the stopper bolt 82 toward the guide mechanism 16. The shock absorbing member 90 is provided with the aim of buffering shocks when the stopper bolt 82 abuts against the end surface of the guide mechanism 16 under a displacement action of the slide table 14.

Figure 8:
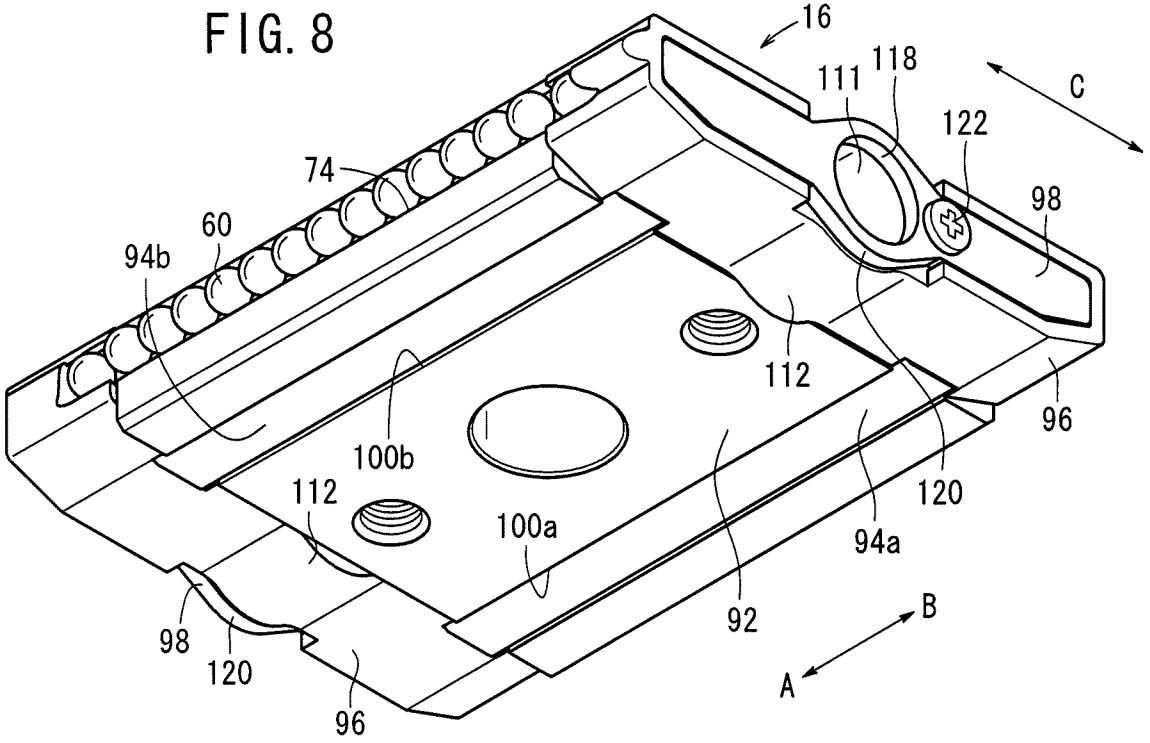
FIG. 8 is an exterior perspective view of a guide mechanism that constitutes part of the linear actuator of FIG. 1.
Figure 9:
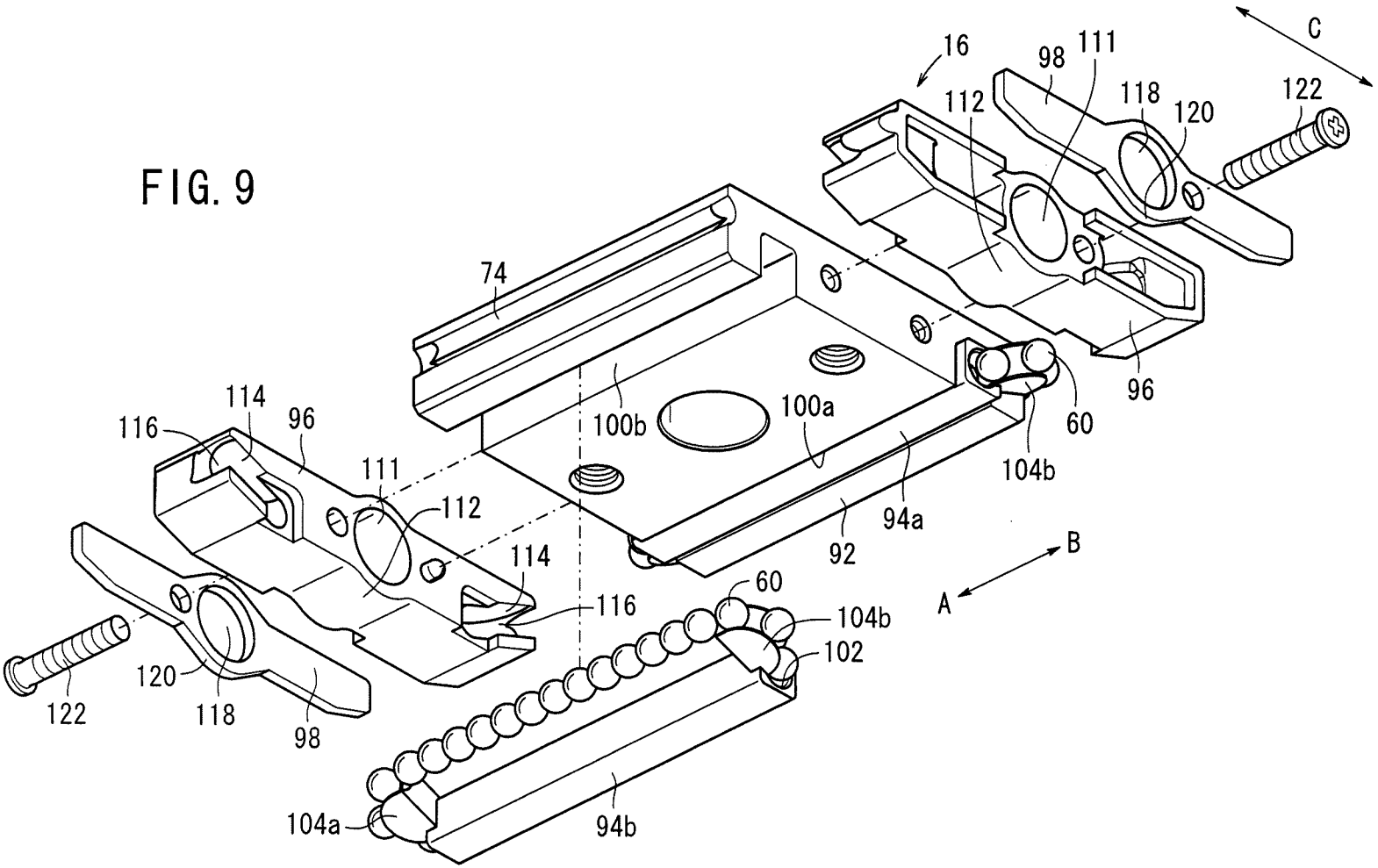
FIG. 9 is an exploded perspective view of the guide mechanism shown in FIG. 8.

As shown in FIGS. 8 and 9, the guide mechanism 16 includes the wide flat guide block 92, a pair of ball circulation members 94*a*, 94*b* disposed on the guide block 92 and through which the balls 60 are circulated, a pair of covers 96 installed respectively on opposite ends along the longitudinal direction of the guide block 92, and a pair of cover plates 98 for covering surfaces of the covers 96 respectively.

The second ball guide grooves 74 are formed along the longitudinal direction on both side surfaces of the guide block 92. At regions proximate to the second ball guide grooves 74, a pair of installation grooves 100*a*, 100*b*, in which the ball circulation members 94*a*, 94*b* are inserted, penetrate therethrough along the longitudinal direction. The second ball guide grooves 74 are semicircular shaped in cross section, and when the slide table 14 is arranged on the upper portion of the guide mechanism 16, the second ball guide grooves 74 are positioned in confronting relation to the first ball guide grooves 62.

The installation grooves 100*a*, 100*b* are formed on the lower surface of the guide block 92, having rectangular shapes in cross section, and open downwardly at opposite ends in the longitudinal direction.

The ball circulation members 94*a*, 94*b* are formed with substantially rectangular shapes in cross section corresponding to the installation grooves 100*a*, 100*b*, and have ball circulation holes 102 penetrating in the interior thereof through which the balls 60 circulate. On opposite ends thereof, roll-reversing sections 104*a*, 104*b* are disposed respectively for reversing the direction in which the balls 60 circulate. The roll-reversing sections 104*a*, 104*b* are formed with semicircular shapes in cross section, and ball grooves in which the balls 60 roll are formed on the outer circumferential surface of the roll-reversing sections 104*a*, 104*b*. Such ball grooves are connected continuously with the ball circulation holes 102.

More specifically, the balls 60 roll from the ball circulation holes 102 in the ball circulation members 94*a*, 94*b*, via the ball grooves of the roll-reversing sections 104*a*, 104*b*, and change 180° in direction to enter into the first and second ball guide grooves (circulation passages) 62, 74 disposed on outer sides of the ball circulation members 94*a*, 94*b*.

The ball circulation members 94*a*, 94*b* are arranged in the guide block 92 such that the ball circulation holes 102 are located downward with respect to the first and second ball guide grooves 62, 74. More specifically, the ball circulation holes 102 and the first and second ball guide grooves 62, 74 are offset by a predetermined height in the vertical direction (the direction of arrow C in FIG. 7).

Further, when the ball circulation members 94*a*, 94*b* are inserted into the installation grooves 100*a*, 100*b* of the guide block 92, flat surface portions 108 of the roll-reversing sections 104*a*, 104*b* abut respectively against end surfaces of the guide block 92 (see FIG. 6), such that the ball circulation holes 102 of the ball circulation members 94*a*, 94*b* and the second ball guide grooves 74 are interconnected.

More specifically, as shown in FIG. 7, in the guide mechanism 16, the ball circulation holes 102 and the first and second ball guide grooves 62, 74 are connected in an inclined orientation by the roll-reversing sections 104*a*, 104*b*.

Owing thereto, a continuous annular ball circulation passage 110 is formed by the ball circulation holes 102 of the ball circulation members 94*a*, 94*b*, the ball grooves, the first ball guide grooves 62 of the slide table 14, and the second ball guide grooves of the guide block 92. The plural balls 60 roll along the ball circulation passage 110, whereby the slide table 14 can be moved smoothly in a reciprocating manner along the guide mechanism 16.

The covers 96 are mounted so as to cover both end surfaces of the guide block 92. Holes 111 that penetrate in the axial direction are formed in the center of the covers 96, and second bulging portions 112 are provided, which bulge outwardly in upward and downward directions about the holes 111 respectively with arcuate shapes in cross section. The second bulging portions 112 are disposed such that when the guide mechanism 16 is mounted on the upper portion of the cylinder main body 12, the second bulging portions 112 can be inserted into the recess 20 of the cylinder main body 12.

On the other hand, inside the covers 96, spaces 114 are formed in which the roll-reversing sections 104*a*, 104*b* are accommodated, and retaining grooves 116 for retaining the balls 60 that roll within the roll-reversing sections 104*a*, 104*b* are formed in such spaces 114. The retaining grooves 116 are formed with arcuate shapes in cross section on radial outward sides of the roll-reversing sections 104*a*, 104*b*, such that the balls 60 are capable of rolling between the retaining grooves 116 and the ball grooves of the roll-reversing sections 104*a*, 104*b*.

Roughly in the center of the cover plates 98, holes 118 are formed, which are of the same diameter and coaxial with the holes 111 of the covers 96. In addition, end surfaces of the guide block 92 are exposed outwardly through the holes 111, 118, and the cover plates 98 have third bulging portions 120 thereon that bulge in upward and downward directions with arcuate shapes in cross section corresponding to the covers 96. The third bulging portions 120 are formed with substantially the same cross sectional shape as the second bulging portions 112 of the covers 96, and are disposed so as to be capable of insertion into the recess 20 of the cylinder main body 12. Further, the aforementioned covers 96 and cover plates 98 are fixed by cover fixing bolts 122 respectively to the end surfaces of the guide block 92.

In addition, when the slide table 14 moves reciprocally, the stopper bolt 82 of the stopper mechanism 18 abuts against the end surface of the guide block 92 via the holes 111, 118.

The linear actuator 10 according to the first embodiment of the present invention basically is constructed as described above. Next, operations and effects of the linear actuator 10 shall be described. The state shown in FIG. 4, in which the end plate 54 of the slide table 14 abuts against the end surface of the cylinder main body 12, shall be described as an initial position.

At first a pressure fluid from a non-illustrated pressure fluid supply source is introduced into the first port 26. In this case, the second port 28 is placed in a state of being open to atmosphere under the operation of a non-illustrated switching valve.

Pressure fluid supplied to the first port 26 is supplied to one of the penetrating holes 30*a* and also is supplied to the other of the penetrating holes 30*b* through the connecting passage 50, whereby the pistons 37 are pressed (in the direction of arrow A) toward the rod holders 46. Consequently, the slide table 14 is displaced together with the piston rods 38, which are connected to the pistons 37, in a direction to separate away from the cylinder main body 12.

At this time, the balls 60 of the guide mechanism 16 roll along the ball circulation passage 110 accompanying displacement of the slide table 14, whereby the slide table 14 is guided in the axial direction by the guide mechanism 16.

Figure 10:
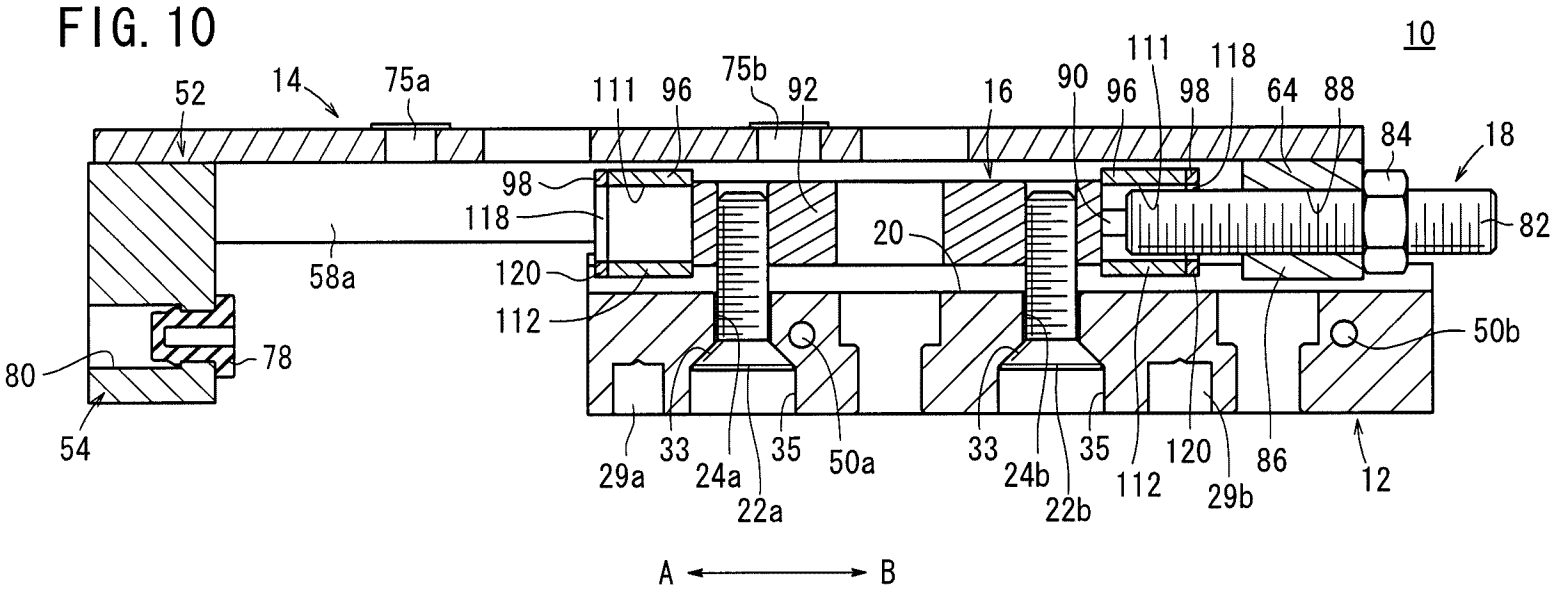
FIG. 10 is an overall vertical cross sectional view showing a condition in which an end plate of the slide table in the linear actuator shown in FIG. 4 is displaced in a direction away from the cylinder main body.
Figure 11:
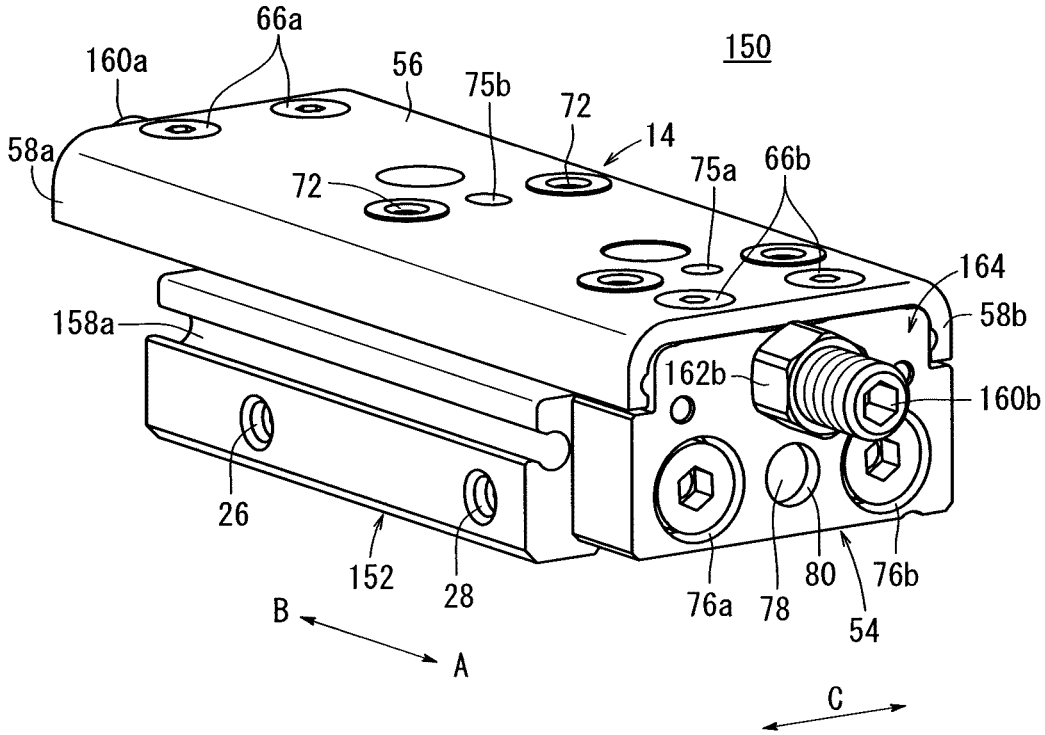
FIG. 11 is an exterior perspective view of a linear actuator according to a second embodiment of the present invention.
Figure 12:
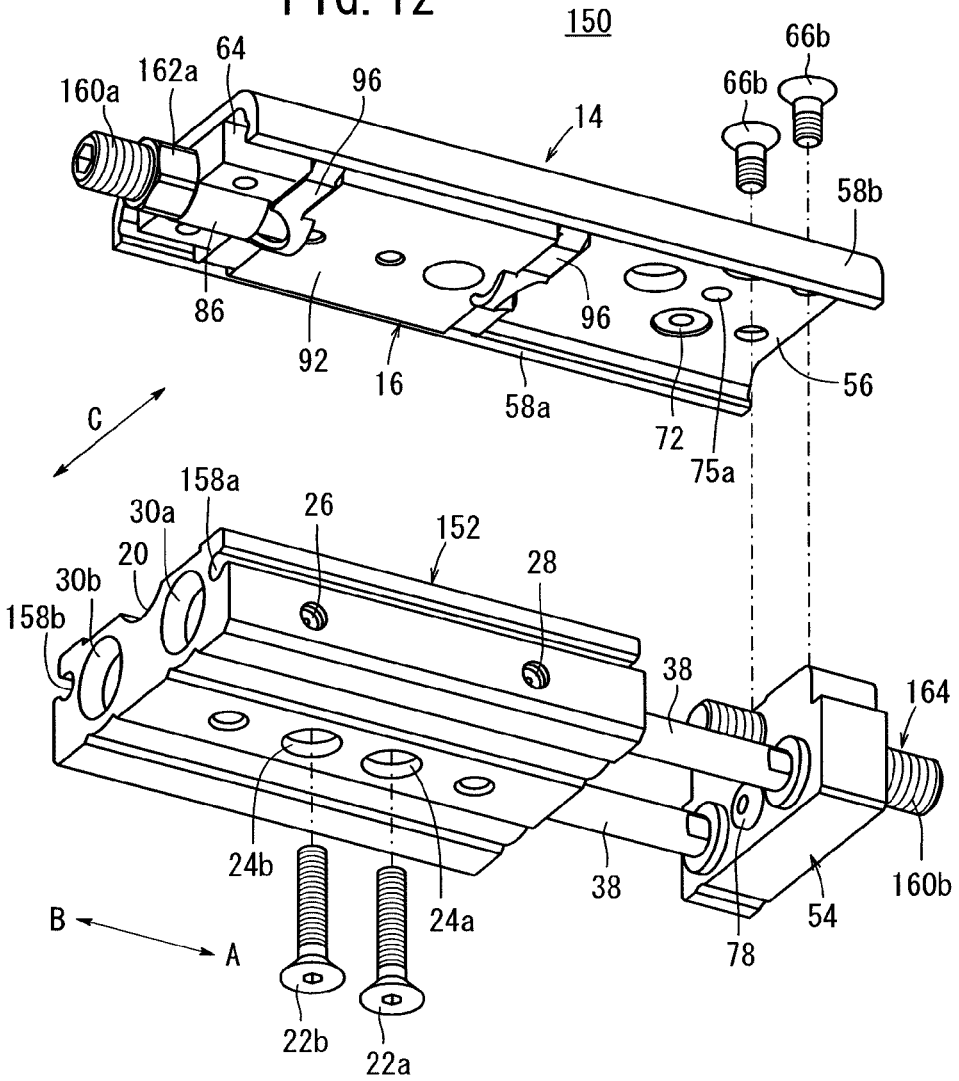
FIG. 12 is an exploded perspective view as seen from a lower side of the linear actuator of FIG. 11.

Then, as shown in FIG. 10, the end of the stopper bolt 82, which is provided at one end of the slide table 14, abuts against the end surface of the guide block 92 of the guide mechanism 16, and displacement of the slide table 14 is stopped, whereupon the slide table 14 reaches a displacement terminal end position.

After loosening the lock nut 84 to enable movement of the stopper bolt 82, the amount at which the stopper mechanism 18 projects from the end surface of the holder portion 64 may be adjusted by threaded-rotation of the stopper bolt 82, whereby the displacement amount of the slide table 14 can also be adjusted.

On the other hand, in the case that the slide table 14 is displaced in a direction opposite to the above direction, i.e., in a direction away from the displacement terminal end position shown in FIG. 10, the pressure fluid, which was supplied to the first port 26, is supplied with respect to the second port 28, whereas the first port 26 is placed in a state of being open to atmosphere. As a result, by means of the pressure fluid, which is supplied into the pair of penetrating holes 30*a*, 30*b* from the second port 28, the pistons 37 are displaced in a direction to separate away from the rod holders 46 (in the direction of arrow B), and the slide table 14 is displaced through the pistons 37 together with the piston rods 38 in a direction to approach the cylinder main body 12. Then, the damper 78, which is disposed on the end plate 54 of the slide table 14, abuts against the end surface of the cylinder main body 12, and the initial position of the linear actuator 10 is restored.

In this manner, according to the first embodiment, in the linear actuator 10 having the cylinder mechanism 40 made up from the pair of pistons 37 and piston rods 38 disposed in the cylinder main body 12, the stopper mechanism 18 that stops displacement of the slide table 14 is disposed substantially in the center of one end of the slide table 14, which is disposed on an upper portion of the cylinder main body 12. Because the stopper mechanism 18 is disposed substantially centrally in the widthwise direction and on one end of the slide table 14, when the slide table 14 is displaced and the stopper bolt 82 of the stopper mechanism 18 abuts against and engages with an end surface of the guide block 92, generation of moments in the lateral direction as viewed from above the linear actuator 10 can be suppressed. As a result, inclination of the slide table 14, which might otherwise occur when the slide table 14 engages with the guide block 92, can be avoided, and movement of the slide table 14 can be stopped reliably and stably.

Further, the ball circulation members 94*a*, 94*b* having the ball circulation holes 102 are disposed in the guide block 92 of the guide mechanism 16, and the guide block 92 is fixed by the two connecting bolts 22*a*, 22*b* to the upper portion of the cylinder main body 12. Owing thereto, compared to a case of being displaced along rails, which are disposed on the body as in a conventional linear actuator, since the length of the ball circulation passage 110 can be shortened, the length in the longitudinal direction of the linear actuator 10 can be made shorter as well. Stated otherwise, the linear actuator 10 can be made smaller in scale in the lengthwise direction thereof.

With a conventional non-circulating type of linear actuator as disclosed in Japanese Laid-Open Patent Publication No. 2008-057679, shifting is likely to occur in the balls (steel balls) that are disposed on left and right sides of the linear actuator, accompanied by inclination (tilting) of the slide table. With respect to this problem, in the linear actuator 10 according to the present invention, which includes the guide mechanism 16 in which the balls 60 are capable of circulating, since shifting of the balls 60 on left and right sides does not occur, a large effect is achieved in that inclination (tilting) of the slide table 14 is suppressed.

Furthermore, the arcuate shaped recess 20 is formed on the upper surface of the cylinder main body 12, and the second bulging portions 112, which bulge outwardly toward the cylinder main body 12, are provided on the covers 96 of the guide mechanism 16 disposed on the upper portion of the cylinder main body 12. The second bulging portions 112 are inserted into the recess 20, and further, corresponding to the cover 96 against which the stopper bolt 82 of the stopper mechanism 18 abuts, the position of the stopper bolt 82 can be arranged more closely to the cylinder main body 12.

Owing thereto, compared to a case of not providing the recess 20 on the cylinder main body 12, the guide mechanism 16 and the stopper mechanism 18 can be positioned more closely to the cylinder main body 12, whereby the height dimension of the linear actuator 10 including the guide mechanism 16 and the like can be suppressed.

Still further, in the height direction of the linear actuator 10 (in the direction of arrow D in FIG. 7), the distance L (see FIG. 7) between the center of the cylinder main body 12 and the center of the stopper bolt 82 of the stopper mechanism 18 can be made smaller, and therefore, when the slide table 14 abuts against and engages with the guide mechanism 16 through the stopper mechanism 18, moments generated in the vertical direction of the linear actuator 10 can be reduced. As a result, inclinations occurring when the slide table 14 is engaged can be suppressed, and the slide table 14 can be stopped reliably and stably.

Further, by providing the first ball guide grooves 62, in which the balls 60 roll, on inner sides of the pair of guide walls 58*a*, 58*b* of the slide table 14, it is unnecessary to fix the guide mechanism 16 with respect to the slide table 14, and thus, the thickness of the slide table 14 can be made thinner. As a result, the height dimension of the linear actuator 10 including the slide table 14 can be suppressed, so that the linear actuator 10 can be made smaller in scale in the height direction.

Furthermore, because a structure is provided in which the holder portion 64 of the stopper mechanism 18 is fixed from above by the bolts 66*a* inserted from above, with respect to one end of the base member 56 in the slide table 14, the thickness of the thus-fixed base member 56 can be made thinner in comparison to a case of being fixed to the base member 56 of the slide table 14 from a frontward direction thereof. As a result, the slide table 14 including the base member 56 can be made thin-walled, and the slide table 14 can be made lightweight accordingly.

Still further, because the damper 78 is disposed in a roughly central portion in the widthwise direction (the direction of arrow C) of the end plate 54, when the slide table 14 is displaced and is stopped in abutment via the damper 78 against the end surface of the cylinder main body 12, generation of moments in a lateral (left-right) direction as viewed from above the linear actuator 10 can be suppressed. As a result, inclination (tilting) of the slide table 14 when the slide table 14 is stopped can be suppressed, and the slide table 14 can be stopped stably and reliably.

Moreover, by providing the first positioning holes 29*a*, 29*b* on the axial line centrally in the widthwise direction (the direction of arrow C) on the lower surface of the cylinder main body 12, and providing the second positioning holes 75*a*, 75*b* for positioning the workpiece (not shown) on the axial line centrally in the widthwise dimension of the slide table 14, for example, when the cylinder main body 12 of the linear actuator 10 is fixed to another apparatus or the like (not shown), by insertion of pins through the first positioning holes 29*a*, 29*b* and into the other apparatus, relative positioning thereof can easily and reliably be accomplished, and together therewith, when the workpiece is mounted on the slide table 14, positioning thereof can be performed easily and with high precision.

More specifically, in the linear actuator 10, every one of the stopper bolt 82 constituting the stopper mechanism 18, the damper 78 disposed on the end plate 54, the first positioning holes 29*a*, 29*b* formed in the lower surface of the cylinder main body 12, and the second positioning holes formed in the slide table 14 is located and disposed centrally in the widthwise direction (the direction of arrow C) of the linear actuator 10, and in the linear actuator 10, the cylinder main body 12, the slide table 14, the guide block 92 and the stopper mechanism 18 are formed with laterally symmetrical shapes. As a result, without giving rise to differences in left and right directions of the linear actuator 10 including the cylinder main body 12 and the slide table 14, the design thereof is simplified.

Further, when the slide table 14 is manufactured, by bending the guide walls 58*a*, 58*b* by press forming using the second positioning holes 75*a*, 75*b* as a reference, and by fabricating (e.g., cutting) the first ball guide grooves 62 using the second positioning holes 75*a*, 75*b* as a reference, the second positioning holes 75*a*, 75*b* can be disposed centrally in the widthwise direction of the slide table 14 with high accuracy.

Next, a linear actuator 150 according to a second embodiment is shown in FIGS. 11 through 16. Structural elements thereof, which are the same as those of the linear actuator 10 according to the above-described first embodiment, are denoted by the same reference characters, and detailed description of such features is omitted.

The linear actuator 150 according to the second embodiment differs from the linear actuator 10 according to the first embodiment, in that, as shown in FIGS. 11 through 16, at the same time that the first and second ports 26, 28 are formed in one side surface of a cylinder main body 152, another third and fourth ports (fluid inlet/outlet ports) 154, 156 (see FIG. 14) for supplying and discharging the pressure fluid are formed in the other side surface of the cylinder main body 152, and in addition, sensor attachment grooves 158*a*, 158*b* (see FIG. 15) are formed respectively on the one side surface and the other side surface of the cylinder main body 152.

Further, the linear actuator 150 also differs from the linear actuator 10 according to the first embodiment, in that a stopper mechanism 164 is provided having a pair of stopper bolts 160*a*, 160*b* and lock nuts 162*a*, 162*b*.

On the other side surface of the cylinder main body 152, the third port 154 is formed at a position on a straight line with the first port 26, and the fourth port 156 is formed at a position on a straight line with the second port 28. In addition, the third and fourth ports 154, 156 communicate respectively with the other penetrating hole 30*b* in the cylinder main body 152, such that after the pressure fluid, which is supplied to the third and fourth ports 154, 156, is introduced into the other penetrating hole 30*b*, the pressure fluid passes through connecting passages 50*a*, 50*b* and is introduced into the one penetrating hole 30*a*.

The first and second ports 26, 28 and the third and fourth ports 154, 156 are used by connecting either one of the pair of ports, which is most appropriate for use in the installation environment of the linear actuator 150, selectively to pipings (not shown). For example, in the case that pipings are connected to the third and fourth ports 154, 156 for supplying and discharging the pressure fluid therethrough, sealing plugs 166 are installed in the first and second ports 26, 28 to seal the same. Conversely, in the case that pipings are connected to the first and second ports 26, 28 for supplying and discharging the pressure fluid therethrough, sealing plugs 166 are installed in the third and fourth ports 154, 156 to seal the same.

On the one side surface and the other side surface of the cylinder main body 152, the sensor attachment grooves 158*a*, 158*b* are formed at positions above the first through fourth ports 26, 28, 154, 156, extending respectively in straight line shapes along the longitudinal direction of the cylinder main body 152 (the direction of arrows A and B). Additionally, non-illustrated detection sensors are mounted respectively in the sensor attachment grooves 158*a*, 158*b*, which enable detection of the displacement position of the pistons 37 by detecting magnetism from the magnets 36 that are installed respectively in the pair of pistons 37.

Further, concerning the stopper mechanism 164, one of the stopper bolts 160*a*, with which the lock nut 162*a* is screw-engaged, is threaded into the holder portion 64 that is fixed to the slide table 14, whereas the other of the stopper bolts 160*b* is threaded into a bolt hole 168 that penetrates through a substantially central portion in the widthwise direction (the direction of arrow C) of the end plate 54. The lock nut 162*b* is threaded onto the stopper bolt 160*b* at a region thereof that projects outside of the end plate 54.

The bolt hole 168 is separated a predetermined distance upwardly from the damper installation hole 80 in the end plate 54, and is formed coaxially with the screw hole 88 of the holder portion 64. More specifically, similarly to the damper 78, the stopper bolt 160*b* is disposed centrally in the end plate 54 in the widthwise direction (in the direction of the arrow C), and the one stopper bolt 160*a* and the other stopper bolt 160*b* are arranged to confront one another on the same axis.

Next, operations of the aforementioned linear actuator 150 shall briefly be explained.

Figure 13:
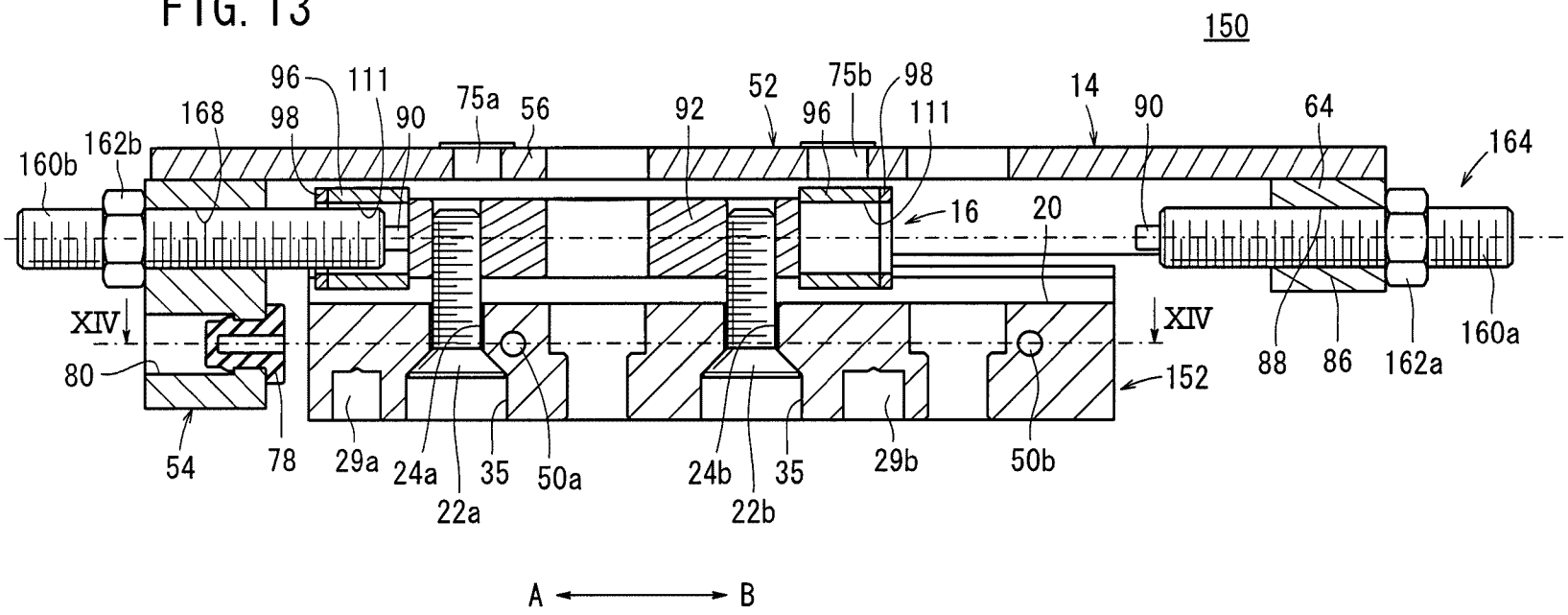
FIG. 13 is an overall vertical cross sectional view of the linear actuator of FIG. 11.
Figure 14:
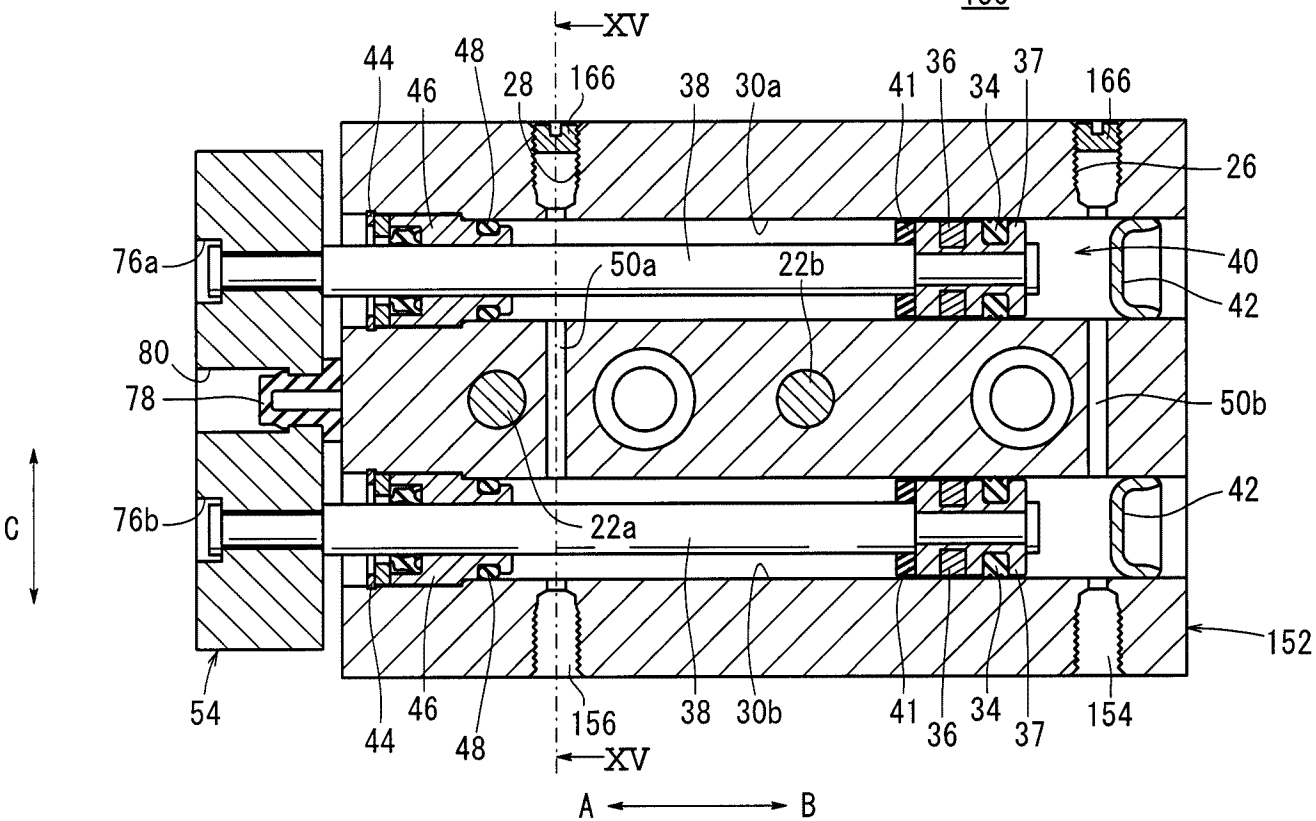
FIG. 14 is a cross sectional view taken along line XIV-XIV of FIG. 13.
Figure 15:
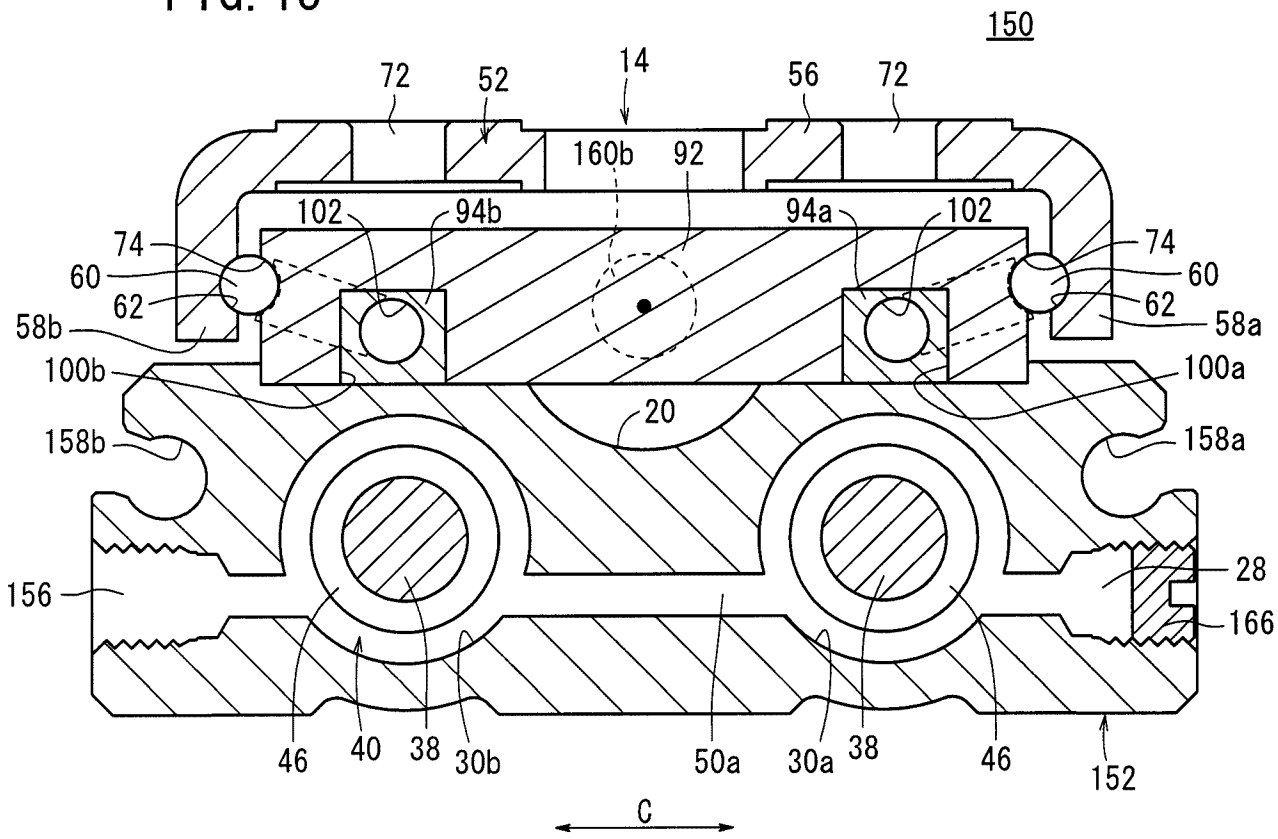
FIG. 15 is a cross sectional view taken along line XV-XV of FIG. 14.

First, from the initial position shown in FIGS. 13 and 14, the pistons 37 are pressed and displaced toward the side of the rod holders 46 (in the direction of arrow A) by a pressure fluid supplied from the third port 154, accompanied by displacement of the slide table 14 together with the piston rods 38 in a direction away from the cylinder main body 152. In this case, the first and second ports 26, 28 are closed and sealed by the sealing plugs 166.

Figure 16:
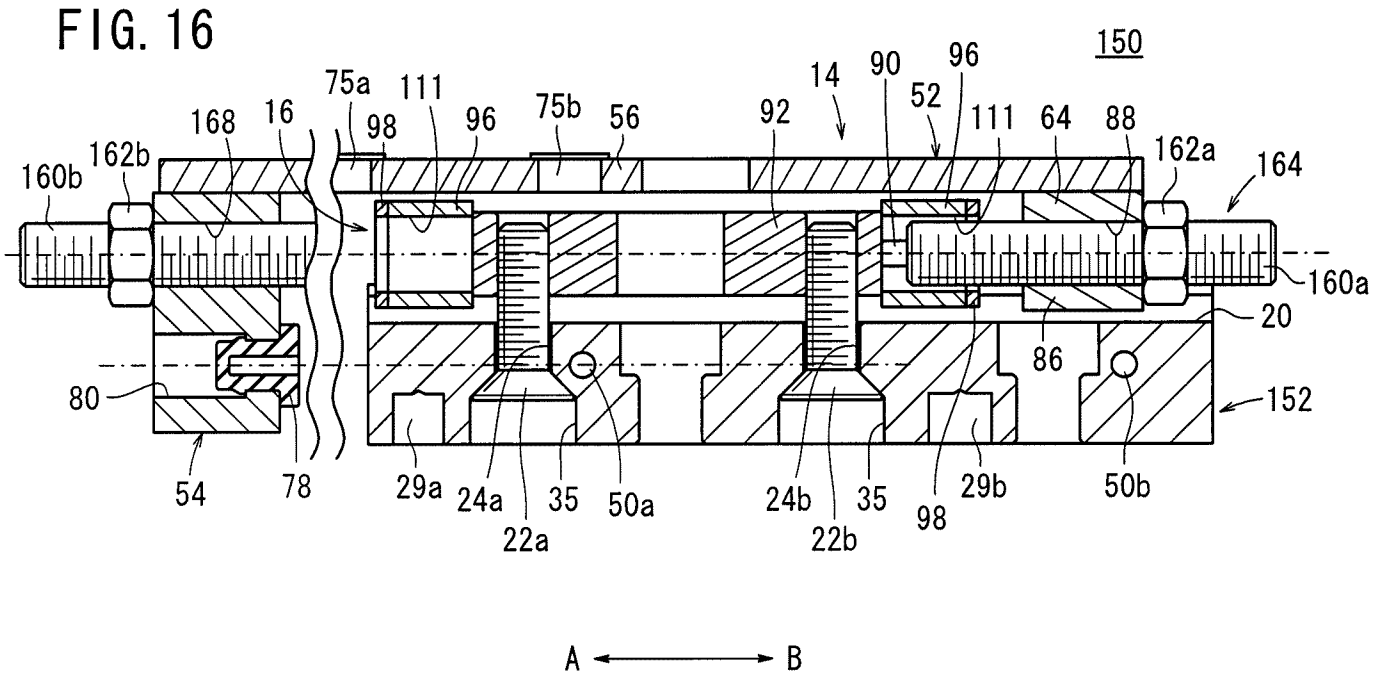
FIG. 16 is an overall vertical cross sectional view showing a condition in which an end plate of a slide table is separated away from a cylinder main body in the linear actuator shown in FIG. 13.

Additionally, by abutment of one of the stopper bolts 160*a* that makes up the stopper mechanism 164 against an end surface of the guide block 92 that constitutes the guide mechanism 16, displacement of the slide table 14 is stopped, whereupon the slide table 14 reaches its terminal end position (see FIG. 16).

On the other hand, in the case that the slide table 14 is displaced in an opposite direction from the terminal end position shown in FIG. 16, by supplying the pressure fluid, which was formerly supplied to the third port 154, with respect to the fourth port 156, the pistons 37 are pressed and displaced in a direction (the direction of arrow B) away from the rod holders 46, accompanied by displacement of the slide table 14 via the piston rods 38 together with the pistons 37 in a direction to approach the cylinder main body 152. In addition, by abutment of the other stopper bolt 160*b* that makes up the stopper mechanism 164 against an end surface of the guide block 92 that constitutes the guide mechanism 16, displacement of the slide table 14 is stopped, whereupon the slide table 14 is returned to its initial position (see FIGS. 13 and 14).

More specifically, with the linear actuator 150 according to the second embodiment, the first and second ports 26, 28 and the third and fourth ports 154, 156 are provided respectively on one side surface and the other side surface of the cylinder main body 152, and because a structure is provided in which supply and discharge of pressure fluid is enabled selectively through the first and second ports 26, 28 or the third and fourth ports 154, 156, a pair of ports can selectively be used, which is most suitable for the installation environment of the linear actuator 150, corresponding to the arrangement of piping, etc., used to supply the pressure fluid.

Further, in a similar manner, because the sensor attachment grooves 158*a*, 158*b* are formed respectively on the one side surface and the other side surface of the cylinder main body 152, a detection sensor can be attached by selecting one of the sensor attachment grooves 158*a*, 158*b* that best corresponds to the installation environment of the linear actuator 150. Moreover, by providing respective detection sensors with respect to both of the sensor attachment grooves 158*a*, 158*b*, the displacement position of the pistons 37 can be detected with even greater accuracy.

Furthermore, the stopper mechanism 164 that stops displacement of the slide table 14 is constituted from the pair of stopper bolts 160*a*, 160*b*, such that one stopper bolt 160*a* is disposed on one end of the slide table 14 in a substantially central portion in the widthwise direction (the direction of arrow C) thereof, whereas the other stopper bolt 160*b* is disposed on the end plate 54 that is connected to the other end of the slide table 14 in a substantially central portion in the widthwise direction (the direction of arrow C) thereof.

Owing thereto, at the initial position and the displacement end position, to which the slide table 14 is displaced and stopped by abutment of the stopper bolts 160*a*, 160*b* respectively against the guide block 92, generation of moments in a lateral (left-right) direction as viewed from above the linear actuator 150 can be suppressed. More specifically, the linear actuator 150 including the stopper mechanism 164 thereof is formed with a symmetrical shape in the lateral (left-right) direction of the linear actuator 150.

As a result, inclination (tilting) of the slide table 14 upon stopping thereof can be suppressed, and compared to a case of providing the stopper bolt 160*a* only on one end side of the slide table 14, generation of moments can be suppressed with greater reliability, whereby the slide table 14 can be stopped more stably and reliably.

Figure 17:
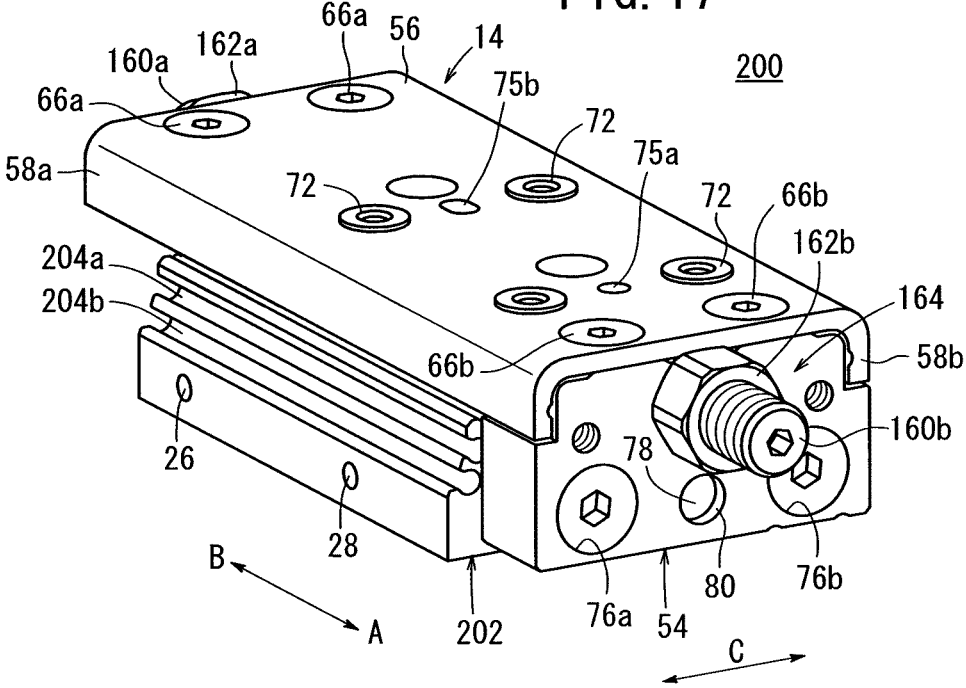
FIG. 17 is an exterior perspective view of a linear actuator according to a modified example.
Figure 18:
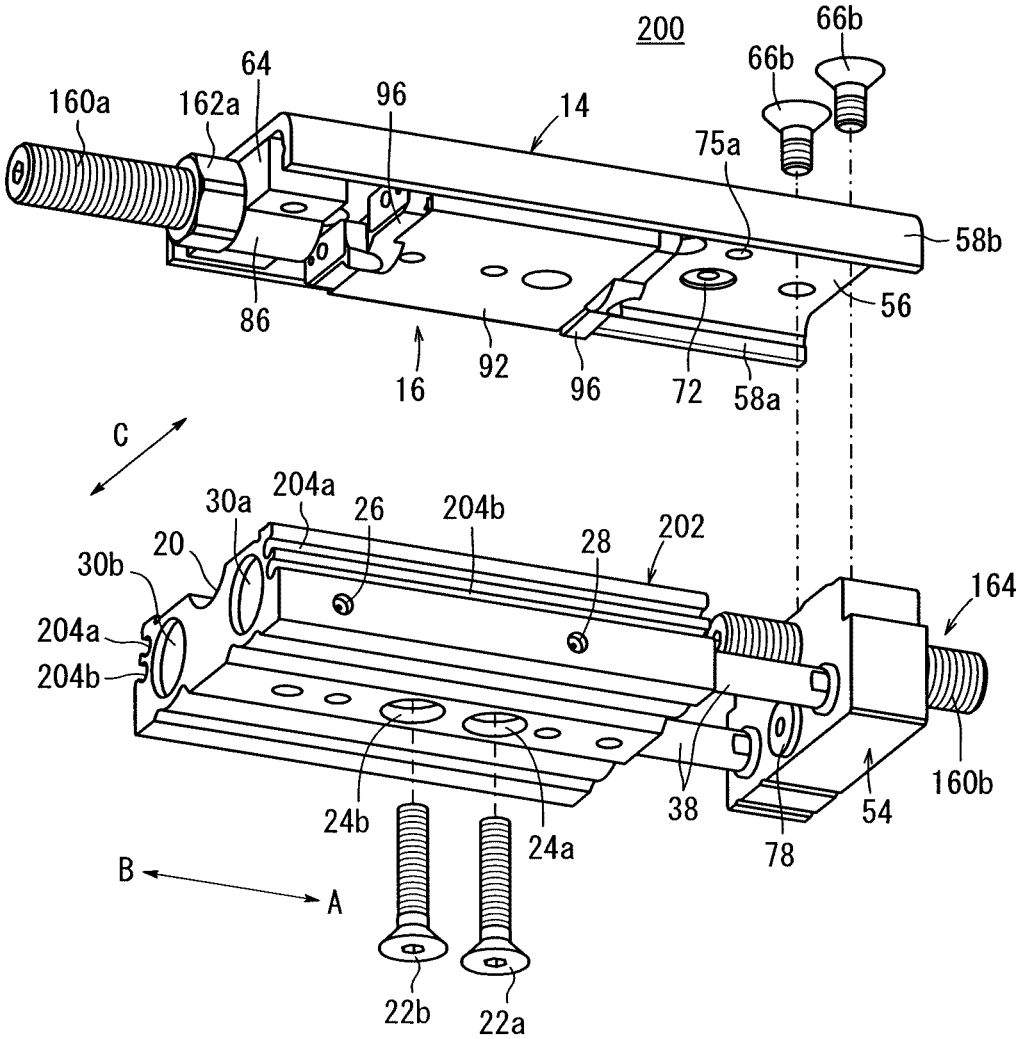
FIG. 18 is an exploded perspective view as seen from a lower side of the linear actuator of FIG. 17.
Figure 19:
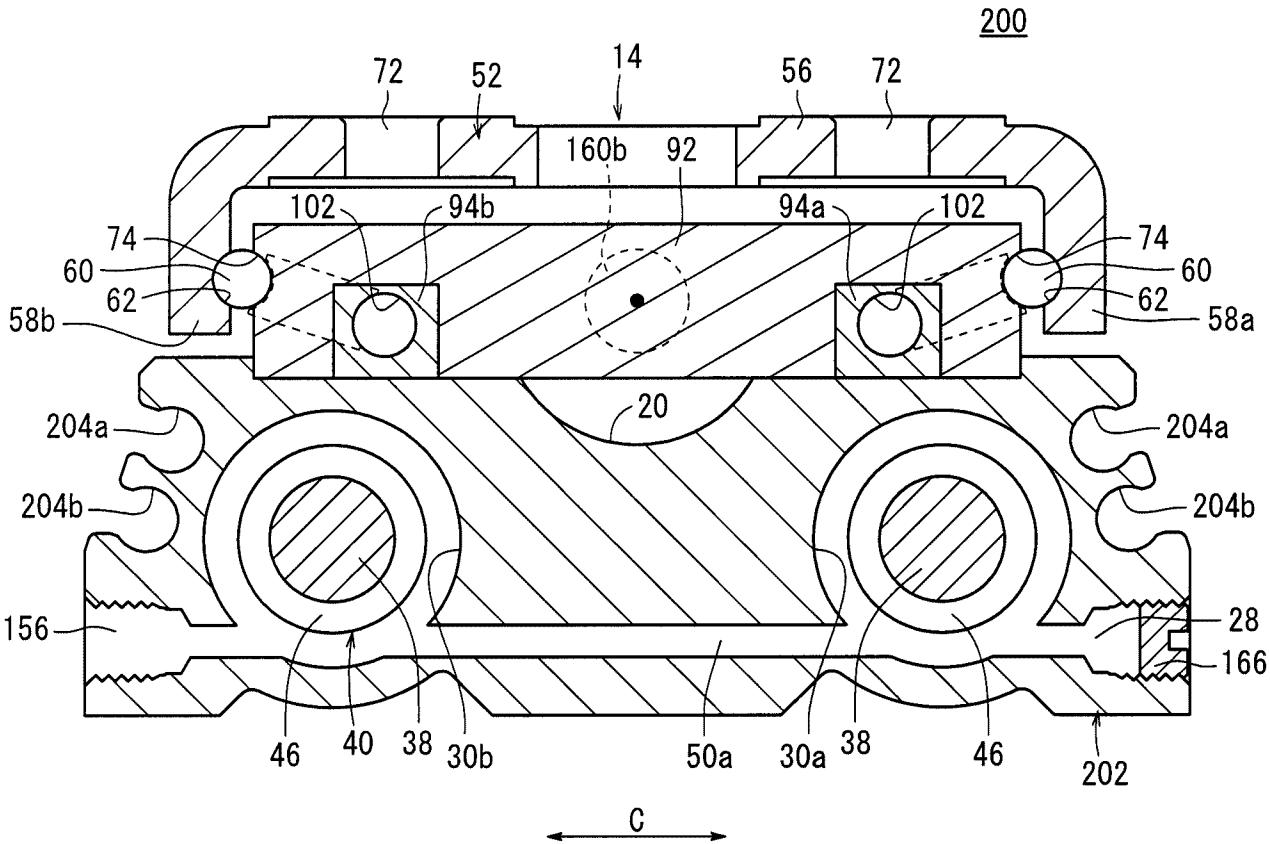
FIG. 19 is a cross sectional view of the linear actuator shown in FIG. 17.

The sensor attachment grooves 158*a*, 158*b* are not limited to the case of being provided one each respectively on one and the other side surfaces of the cylinder main body 152 as described above. For example, as in the linear actuator 200 shown in FIGS. 17 through 19, two-tiered sensor attachment grooves 204*a*, 204*b*, which are separated a predetermined distance in the height direction of a cylinder main body 202, may be provided respectively extending along the longitudinal direction (the direction of arrows A and B) of the cylinder main body 202.

In this case, for example, a detection sensor for detecting the initial position of the pistons 37 may be provided in one of the sensor attachment grooves 204*a*, whereas another detection sensor for detecting the displacement terminal end position of the pistons 37 may be provided in the other of the sensor attachment grooves 204*b*, whereby the initial position and the displacement terminal end position of the pistons 37 can be detected with greater precision.

Figure 20:
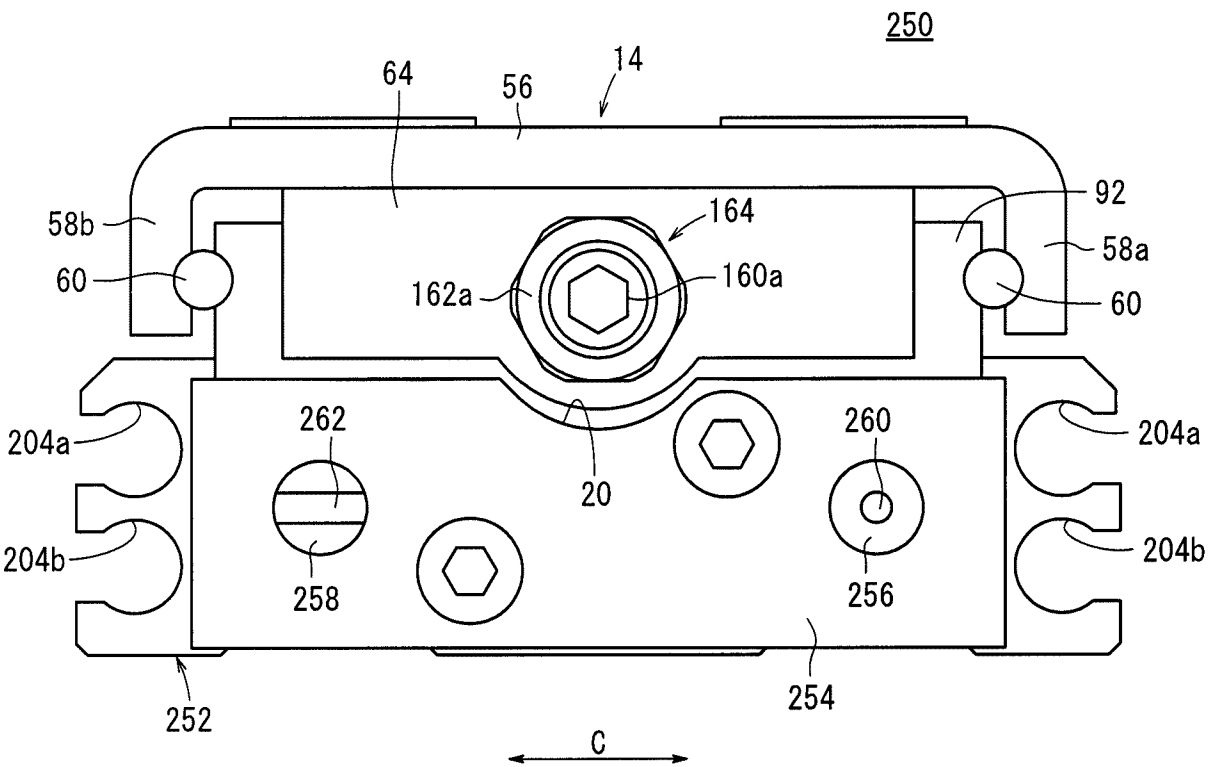
FIG. 20 is a front view of a linear actuator according to a third embodiment of the present invention.
Figure 21:
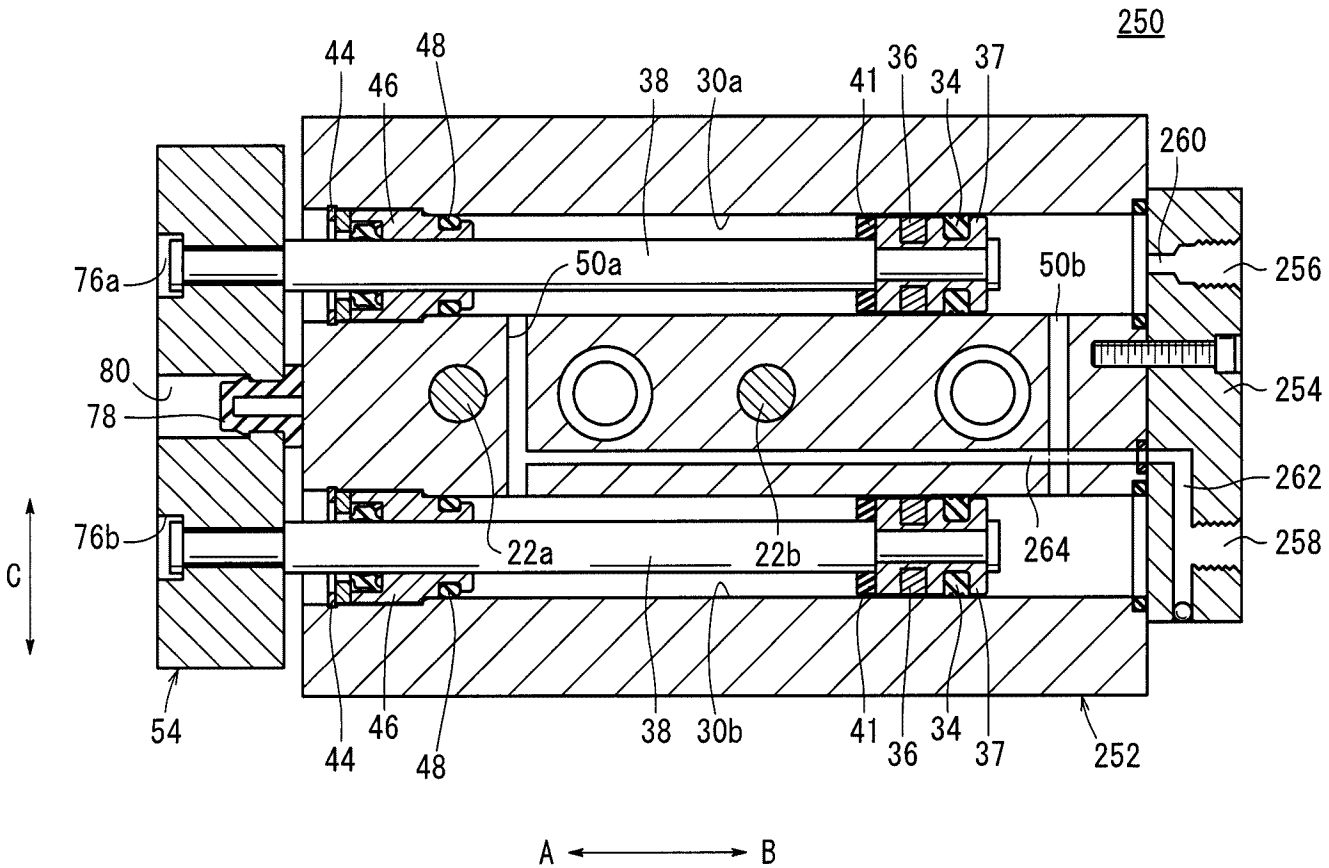
FIG. 21 is a transverse cross sectional view of the linear actuator shown in FIG. 20.

Next, a linear actuator 250 according to a third embodiment is shown in FIGS. 20 through 21. Structural elements thereof, which are the same as those of the linear actuators 10, 150 according to the above-described first and second embodiments, are denoted by the same reference characters, and detailed description of such features is omitted.

The linear actuator 250 according to the third embodiment differs from the linear actuator 10, 150 according to the first and second embodiments, in that, instead of providing first and second ports 26, 28 in one side surface and the other side surface of the cylinder main body 12, first and second ports 256, 258 are provided in an end block 254, which is connected to an end of the cylinder main body 252.

The end block 254 is connected to one end of the cylinder main body 252 so as to close and seal the penetrating holes 30*a*, 30*b*. The first and second ports 256, 258 are formed in an end surface of the end block 254, separated a given distance in the widthwise direction and extending toward the side of the cylinder main body 252 (in the direction of arrow A).

The first port 256 communicates with an end of one of the penetrating holes 30*a* through a first communication passage 260. The second port 258 is connected to a second communication passage 262, which extends in a widthwise direction (in the direction of arrow C) inside the end block 254, and is connected to a connecting passage 50*a*, which is arranged on the side of the end plate 54 through a third communication passage 264 formed between the pair of penetrating holes 30*a*, 30*b* in the cylinder main body 252. More specifically, pressure fluid, which is supplied from the second port 258, passes through the second and third communication passages 262, 264 and the connecting passage 50*a*, and is supplied respectively between the pistons 37 and the rod holders 46 in the penetrating holes 30*a*, 30*b*. Further, the third communication passage 264 is formed so as not to be in communication with the connecting passage 50*b* on the side of the end block 254 (in the direction of arrow B).

In this manner, by connecting the end block 254 having the first and second ports 256, 258 to one end in the longitudinal direction (the direction of arrows A and B) of the cylinder main body 252, because connections to pipings can be established in the longitudinal direction of the cylinder main body 252, for example, such an arrangement can be applied to installation environments in which space for connection of pipings to one end side and the other end side of the cylinder main body 252 cannot be secured.

The linear actuator according to the present invention is not limited to the embodiments described above, but various alternative or additional features and structures may be adopted without deviating from the essence and scope of the invention as set forth in the appended claims.

What is claimed is:

1. A linear actuator in which, by introduction of a pressure fluid from fluid inlet/outlet ports, a slide table is made to move reciprocally along an axial direction of a cylinder main body, comprising:

the cylinder main body, which communicates with the fluid inlet/outlet ports, and having a pair of cylinder chambers into which the pressure fluid is introduced;

the slide table, which moves reciprocally along the axial direction of the cylinder main body;

a cylinder mechanism having a pair of pistons which are slidable along the cylinder chambers, wherein the slide table is made to move reciprocally under a displacement action of the pistons;

a guide mechanism for guiding the slide table along the axial direction of the cylinder main body is disposed between the slide table and the cylinder main body, the guide mechanism being attached to an upper portion of the cylinder main body and having a flat guide block with circulation passages formed therein through which a plurality of rolling bodies roll and circulate; and a stopper mechanism disposed on one end of the slide table centrally in a widthwise direction thereof perpendicular to an axial direction of the slide table for regulating reciprocal movement of the slide table, wherein the stopper mechanism is displaced together with the slide table and abuts against an end of the guide block, and wherein an arc-shaped recess which is sunken in a direction away from the slide table is provided on an upper surface of the cylinder main body facing the guide mechanism and the slide table, the recess extends the entire length of the cylinder main body, and a portion of the stopper mechanism is inserted into the recess.

2. The linear actuator according to claim 1, wherein the guide block is fixed to the cylinder main body.

3. The linear actuator according to claim 1, wherein guide grooves in which the rolling bodies are guided are formed in wall members of the slide table that face toward side surfaces of the guide block.

4. The linear actuator according to claim 3, wherein the wall members are formed perpendicularly with respect to a base member which is disposed above the cylinder main body and is parallel to an upper surface of the cylinder main body.

5. The linear actuator according to claim 1, wherein the stopper mechanism is disposed on at least one of one end and another end of the slide table along the axial direction thereof.

6. The linear actuator according to claim 1, wherein the stopper mechanism further comprises a retaining member disposed downwardly of the slide table, and a stopper bolt, which is screw-engaged with respect to the retaining member so as to be capable of advancing and retracting in the axial direction, the retaining member being connected to the slide table by a fastening member, which is inserted from above with respect to the slide table.

7. The linear actuator according to claim 6, wherein the retaining member has, in a central portion thereof, a bulging portion that bulges with an arcuate shape in cross section toward the cylinder main body.

8. The linear actuator according to claim 7, wherein the recess is an arcuate shape in cross section corresponding to the bulging portion.

9. The linear actuator according to claim 1, wherein the fluid inlet/outlet ports are disposed respectively on opposite side surfaces of the cylinder main body, the fluid inlet/outlet ports disposed on one of the side surfaces being used selectively.

10. The linear actuator according to claim 1, wherein sensor attachment grooves, in which a detection sensor can be mounted that is capable of detecting a displacement position of the pistons, are formed respectively on the axial direction of the cylinder main body.

11. The linear actuator according to claim 1, wherein positioning holes are disposed in the cylinder main body and in the slide table in central portions thereof in a widthwise direction perpendicular to the axial direction.

12. The linear actuator according to claim 1, wherein the guide mechanism further comprises a pair of ball circulation members disposed on the guide block through which the plurality of rolling bodies circulate.

13. The linear actuator according to claim 12, wherein the flat guide block further comprises a pair of grooves formed into the bottom surface and extend along the axial direction of the flat guide block and wherein the corresponding pair of ball circulation members are fitted into the corresponding grooves.

14. The linear actuator according to claim 13, wherein a pair of covers are attached to axially opposite ends of the flat guide block, and secure the corresponding pair of ball circulation members into the corresponding grooves.

* * * * *